US010416595B2

(12) United States Patent
Ogura et al.

(10) Patent No.: US 10,416,595 B2
(45) Date of Patent: Sep. 17, 2019

(54) IMAGE FORMING APPARATUS HAVING A CONTROL CIRCUIT THAT SELECTIVELY CONTROLS POWER TO BE SUPPLIED TO A PLURALITY OF HEAT GENERATING BLOCKS OF A HEATER

(71) Applicant: CANON KABUSHIKI KAISHA, Tokyo (JP)

(72) Inventors: Ryota Ogura, Numazu (JP); Yuji Fujiwara, Susono (JP); Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/979,845

(22) Filed: May 15, 2018

(65) Prior Publication Data

US 2018/0335737 A1 Nov. 22, 2018

(30) Foreign Application Priority Data

May 17, 2017 (JP) ..... 2017-098248
Nov. 20, 2017 (JP) ..... 2017-223013

(51) Int. Cl.
*G03G 15/20* (2006.01)
*G03G 15/00* (2006.01)

(52) U.S. Cl.
CPC ..... *G03G 15/2039* (2013.01); *G03G 15/2042* (2013.01); *G03G 15/2053* (2013.01); *G03G 15/80* (2013.01)

(58) Field of Classification Search
USPC ..... 399/69
See application file for complete search history.

(56) References Cited

U.S. PATENT DOCUMENTS 8,494,383 B2 7/2013 Shimura et al.
8,606,136 B2 12/2013 Shimura et al.
(Continued)

FOREIGN PATENT DOCUMENTS

EP 0 604 976 A1 7/1994
JP 2015129789 A 7/2015
(Continued)

OTHER PUBLICATIONS

Extended European Search Report dated Aug. 22, 2018, issued in European Application No. 18172562.3.

*Primary Examiner* — Quana Grainger
(74) *Attorney, Agent, or Firm* — Venable LLP

(57) ABSTRACT

An image forming apparatus includes a control circuit having a plurality of semiconductor elements configured to perform switching between ON and OFF of a plurality of heat generating blocks, and a power interrupting unit configured to be activated so as to interrupt power being supplied to the plurality of semiconductor elements when a heater overheats. Of the plurality of semiconductor elements, a first semiconductor element to supply power to a first heat generating block, is connected, in series, to a second semiconductor element to supply power to a second heat generating block. In addition, when the power interrupting unit is not activated, the second heat generating block is controlled by controlling only the second semiconductor element, and, when the power interrupting unit is not activated, the first heat generating block is controlled by controlling the first semiconductor element and the second semiconductor element.

13 Claims, 16 Drawing Sheets

(56) References Cited

U.S. PATENT DOCUMENTS

| | | | | |
|---|---|---|---|---|
| 8,642,927 | B2 | 2/2014 | Shimura | |
| 8,653,422 | B2 | 2/2014 | Shimura et al. | |
| 8,698,046 | B2 | 4/2014 | Shimura et al. | |
| 8,818,214 | B2 | 8/2014 | Shimura | |
| 8,859,940 | B2 | 10/2014 | Shimura | |
| 8,884,192 | B2 | 11/2014 | Shimura | |
| 8,977,155 | B2 | 3/2015 | Shimura | |
| 8,995,859 | B2 | 3/2015 | Ogura | |
| 9,031,440 | B2 | 5/2015 | Fujiwara | |
| 9,086,663 | B2 | 7/2015 | Shimura et al. | |
| 9,170,550 | B2 | 10/2015 | Shimura et al. | |
| 9,229,384 | B2 | 1/2016 | Shimura et al. | |
| 9,268,280 | B2 | 2/2016 | Shimura | |
| 9,298,142 | B2 | 3/2016 | Shimura | |
| 9,658,581 | B2 | 5/2017 | Mochizuki et al. | |
| 9,927,745 | B2 | 3/2018 | Yoshimura | |
| 2005/0063724 | A1* | 3/2005 | Kodama ..... | G03G 15/2039 399/67 |
| 2014/0193182 | A1 | 7/2014 | Shimura et al. | |
| 2017/0075266 | A1 | 3/2017 | Mochizuki et al. | |
| 2018/0032009 | A1 | 2/2018 | Ogura | |

FOREIGN PATENT DOCUMENTS

| | | | |
|---|---|---|---|
| JP | 2015194713 | A | 11/2015 |
| JP | 2017054071 | A | 3/2017 |
| JP | 2017054072 | A | 3/2017 |
| WO | 2017/043020 | A1 | 3/2017 |

* cited by examiner

IMAGE FORMING APPARATUS HAVING A CONTROL CIRCUIT THAT SELECTIVELY CONTROLS POWER TO BE SUPPLIED TO A PLURALITY OF HEAT GENERATING BLOCKS OF A HEATER

This application claims the benefit of Japanese Patent Application No. 2017-098248, filed on May 17, 2017, and Japanese Patent Application No. 2017-223013, filed on Nov. 20, 2017, both of which are incorporated by reference herein in their entireties.

BACKGROUND OF THE INVENTION

Field of the Invention

The present invention relates to an image heating apparatus, such as a copier that uses an electrophotographic system or an electrostatic recording system, a fixing unit that is installed in such an image forming apparatus as a printer, or a gloss applying apparatus that improves a gloss level of a toner image by reheating a toner image already fixed onto a recording material. The present invention also relates to an image forming apparatus that includes this image heating apparatus.

Description of the Related Art

A conventional fixing apparatus that is included in an image forming apparatus is an apparatus having an endless belt (also called "endless film"), a flat heater that contacts an inner surface of the endless belt, and a roller that constitutes a nip portion with the heater via the endless belt. If a small sized paper is continuously printed by an image forming apparatus including this fixing apparatus, the temperature in a region of the nip portion in which paper does not pass in the longitudinal direction may gradually increase (temperature rise in non-paper passing portion). If the temperature in the non-paper passing portion increases too much, parts in the apparatus may be damaged. A method of suppressing the temperature rise in the non-paper passing portion that is proposed is a heater in which a heat generating element is disposed between two conductors arranged along the longitudinal direction, and at least one of the conductors is divided by a width corresponding to the paper size, so that heat generating is controlled for each heat generating block (Japanese Patent Application Publication No. 2017-54071).

If a plurality of thermistors (temperature detecting elements) are disposed in each of the divided heat generating blocks, however, as in Japanese Patent Application Publication No. 2017-54071, the number of wires connected with the thermistors increases as the heat generating regions increase, which may interfere with the downsizing of the apparatus.

It is an object of the present invention to provide a technique that enables downsizing of the apparatus by decreasing the number of temperature detecting elements.

SUMMARY OF THE INVENTION

In one aspect, the present invention provides an image forming apparatus including a fixing portion configured to fix an image, formed on a recording material, onto the recording material, the fixing portion including a heater that includes a substrate, a plurality of heat generating blocks arranged on the substrate in a longitudinal direction of the substrate, and a plurality of temperature detecting elements disposed on the substrate, and a control circuit configured to control power to be supplied to the plurality of heat generating blocks, the control circuit including a plurality of semiconductor elements configured to perform switching between ON and OFF of the plurality of heat generating blocks, and selectively controls the power to be supplied to the plurality of heat generating blocks by selectively controlling the plurality of semiconductor elements, wherein, out of the plurality of heat generating blocks, a first semiconductor element to supply power to a first heat generating block is connected, in series, to a second semiconductor element to supply power to a second heat generating block out of the plurality of heat generating blocks, the second heat generating block is controlled by controlling the second semiconductor element, and the first heat generating block is controlled by controlling the first semiconductor element and the second semiconductor element.

Further features of the present invention will become apparent from the following description of exemplary embodiments, with reference to the attached drawings.

DESCRIPTION OF THE EMBODIMENTS

Hereafter, a description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Example 1

Figure 1:
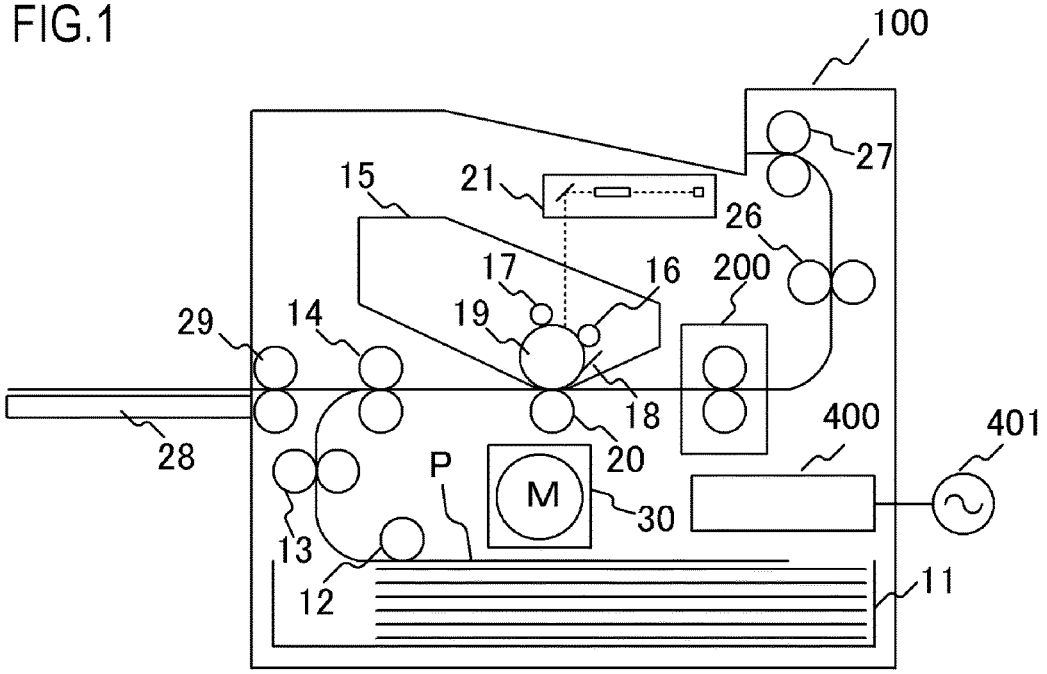
FIG. 1 is a cross-sectional view depicting an image forming apparatus according to an example of the present invention.

FIG. 1 is a schematic cross-sectional view depicting an image forming apparatus according to an example of the present invention. An image forming apparatus 100 of Example 1 is a laser printer that forms an image on a recording material using an electrophotographic system.

When a print signal is generated, a scanner unit 21 emits a laser light modulated in accordance with the image information, and scans the surface of a photosensitive drum (electrophotographic photosensitive member) 19, which is charged to a predetermined polarity by a charging roller 16. Thereby, an electrostatic latent image is formed on the photosensitive drum 19, which is an image bearing member. When toner, which is charged to a predetermined polarity, is supplied from a developing roller 17 to this electrostatic latent image, the electrostatic latent image on the photosensitive drum 19 is developed as a toner image (developer image). On the other hand, a recording material (recording paper) P, stacked in a paper feeding cassette 11, is fed one sheet at a time by a pick up roller 12, and is conveyed to a resist roller pair 14 by a conveying roller pair 13. Further, to match a timing when the toner image on the photosensitive drum 19 reaches a transfer position, which is determined by the photosensitive drum 19 and a transfer roller 20 (transfer member), the recording material P is conveyed from the resist roller pair 14 to this transfer position. While the recording material P passes through the transfer position, the toner image on the photosensitive drum 19 is transferred to the recording material P. Then the recording material P is heated by a fixing apparatus (image heating apparatus) 200, which is a fixing portion (image heating portion), whereby the toner image is heated and fixed to the recording material P. The recording material P, which bears the fixed toner image, is discharged to a paper delivery tray 31 located in the upper part of the image forming apparatus 100 via the conveying roller pairs 26 and 27.

Residual toner, and the like, on the surface of the photosensitive member 19 are removed and cleaned by a cleaner 18. A feeding tray (manual feed tray) 28 has a pair of recording paper control plates of which a width can be adjusted in accordance with the size of the recording paper P, so that recording paper P, other than a standard size, can be handled. A pick up roller 29 is a roller to feed the recording paper P from the feeding tray 28. A motor 30 drives a roller, and the like, in the fixing apparatus 200.

The above mentioned photosensitive drum 19, charging roller 16, scanner unit 21, developing roller 17, and transfer roller 20 constitute an image forming portion that forms a unfixed image on the recording material P. In Example 1, a developing unit that includes the photosensitive drum 19, the charging roller 16, and the developing roller 17, and a cleaning unit that includes the cleaner 18, are detachably attached to the main body of the image forming apparatus 100 as process cartridges 15.

Figure 2:
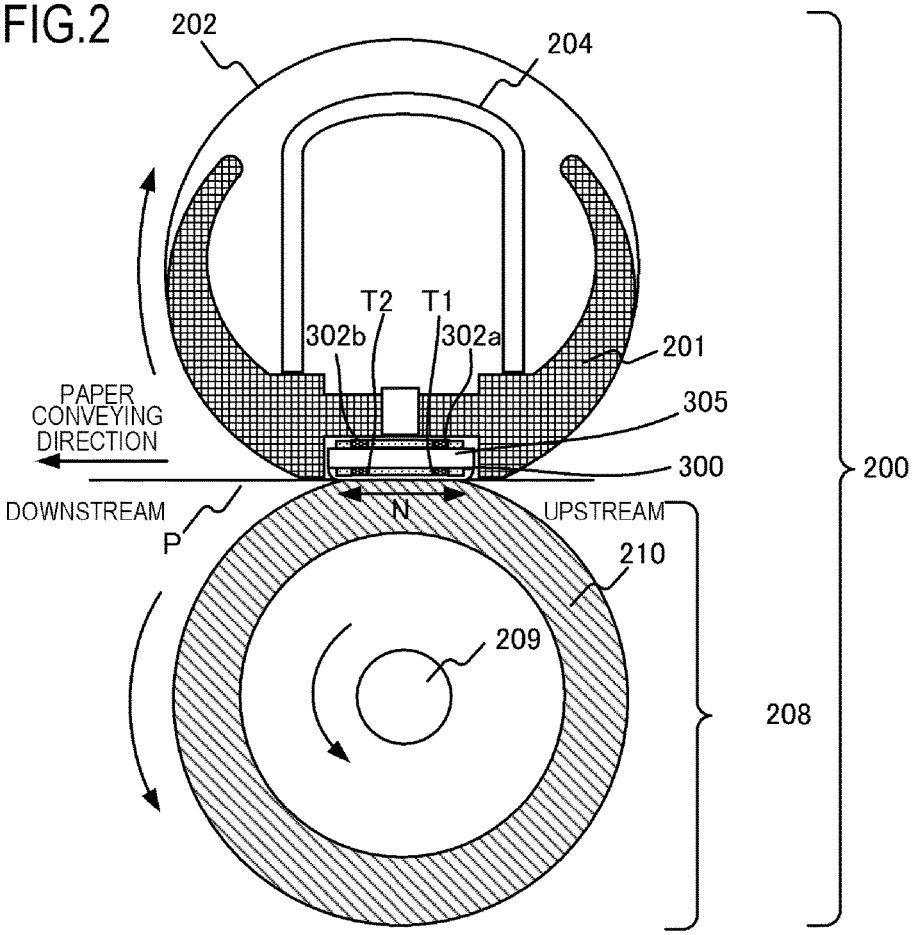
FIG. 2 is a cross-sectional view depicting a fixing apparatus according to Example 1.

FIG. 2 is a cross-sectional view of the fixing apparatus 200 in Example 1. The fixing apparatus 200 includes a fixing film (hereafter called "film") 202, a heater 300 that contacts the inner surface of the film 202, a pressure roller 208 that constitutes a fixing nip portion N with the heater 300 via the film 202, and a metal stay 204.

The film 202 is a heat resistant film, referred to as an endless belt or an endless film, that is formed in a cylindrical or tubular shape, and the material of the base layer of the film is a heat resistant resin (e.g., polyimide) or a metal (e.g., stainless). An elastic layer, such as a heat resistant rubber, may be formed on the surface of the film 202. The pressure roller 208 has a metal core 209 (e.g., iron, aluminum) and an elastic layer 210 (e.g., silicon robber). The heater 300 is held by a holding member 201 made of a heat resistant resin. The holding member 201 also has a guide function that guides the rotation of the film 202. The metal stay 204 is for applying pressure of a spring (not illustrated) to the holding member 201. The pressure roller 208 rotates in the arrow direction by being powered by the motor 30. The film 202 is rotated by the rotation of the pressure roller 208. The recording paper P, bearing the unfixed toner image, is heated while being held and conveyed by the fixing nip portion N, whereby fixing processing is performed.

The heater 300 includes heat generating elements (heat generating resistors) 302*a* and 302*b* disposed on a later mentioned ceramic substrate 305. A protecting element 212 (FIG. 4) is contacted to the heater 300. The protecting element 212 is, for example, a thermoswitch or a temperature fuse, and is activated when the heater 300 is abnormally heated so as to interrupt the power supplied to the heater 300. On a sliding surface side of the heater 300 facing the film 202, thermistors T1 (T1-1 to T1-7, see FIG. 3B) and thermistors T2 (T2-2 to T2-6, see FIG. 3B) are disposed.

Figure 3A:
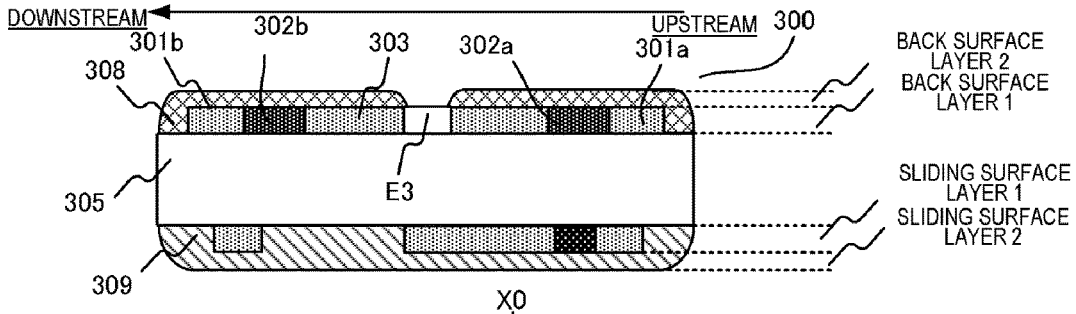
FIGS. 3A and 3B show a configuration of a heater according to Example 1.
Figure 3B:
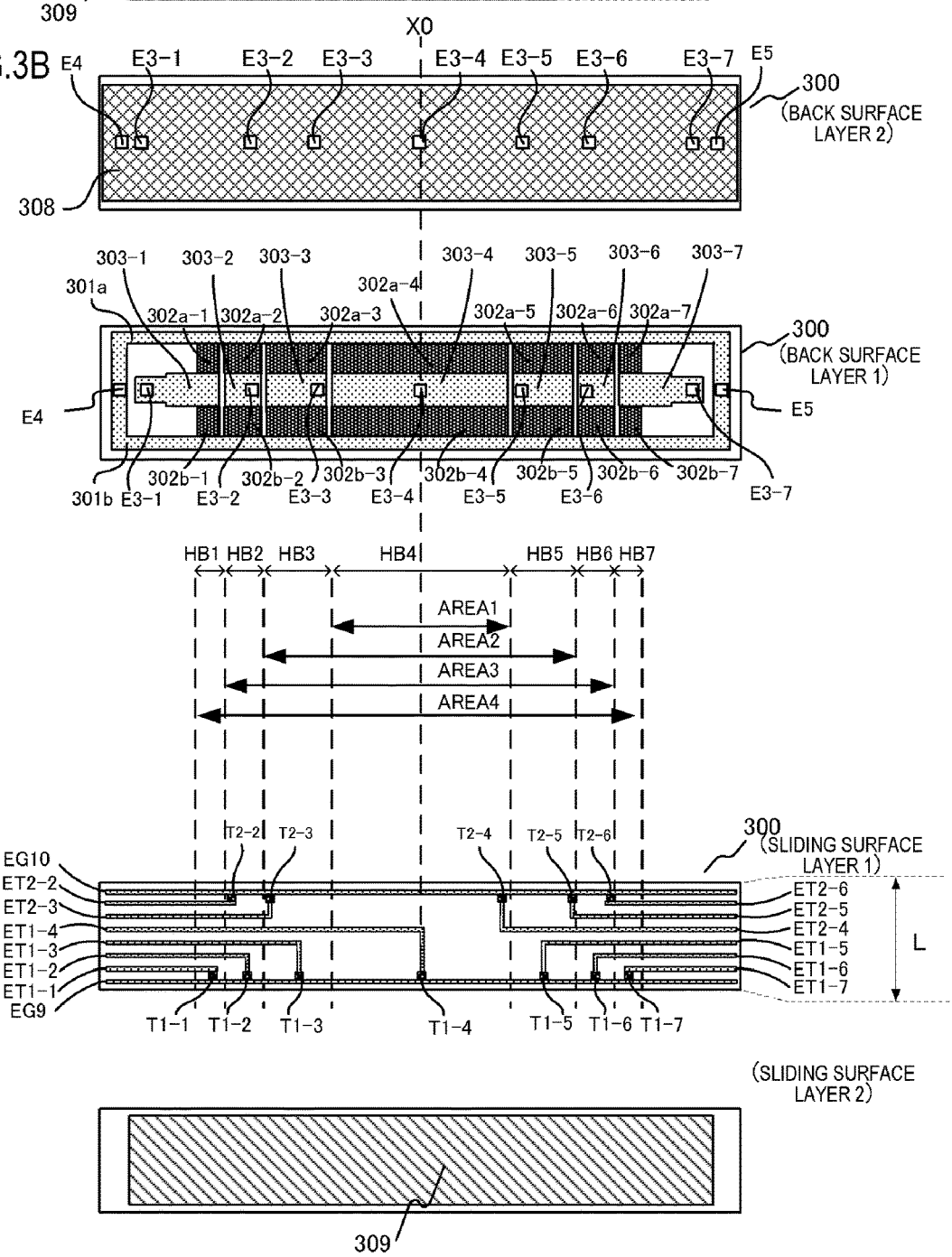

The configuration of the heater 300 according to Example 1 will be described with reference to FIGS. 3A and 3B. FIG. 3A is a cross-sectional view of the heater 300, and FIG. 3B is a plan view of each layer of the heater 300. In FIG. 3B, a conveyance reference position X0 of the recording material P, in the image forming apparatus 100 of Example 1, is indicated. In Example 1, the conveyance reference position X0 is the center of the heater 300, and the recording material P is conveyed such that the center line of the recording material, in the direction perpendicular to the conveying direction, is always on the conveyance reference position X0. FIG. 3A is a cross-sectional view of the heater 300 at the conveyance reference position X0.

As illustrated in FIG. 3A, the heater 300 has a conductor 301 and a conductor 303, which are disposed on a substrate 305. The conductor 301 is divided into a conductor 301*a*, which is disposed on the upstream side of the conveying direction of the recording material P, and a conductor 301*b*, which is disposed on the downstream side thereof. Further, in the heater 300, a heat generating element 302, which is heated by the power supplied via the conductor 301 and the conductor 303, is disposed on the substrate 305 between the conductor 301 and the conductor 303. This heat generating element 302 is divided into a heat generating element 302*a*, which is disposed on the upstream side of the conveying direction of the recording material P, and a heat generating element 302*b*, which is disposed on the downstream side thereof. Further, an electrode E3 is disposed to supply power. Furthermore, an insulating protective glass 308 is disposed on the back surface layer 2, and the protective glass 308 covers the heater 300 excluding the electrode E3. The heater 300 (substrate 305) is disposed such that the longitudinal direction of the heater 300 is perpendicular to the conveying direction of the recording material P.

As illustrated in FIG. 3B, on the back surface layer 1 of the heater 300, seven heat generating blocks (heating regions), each of which is constituted by a group having the conductor 301, the conductor 303, the heat generating element 302, and the electrode E3, are disposed in the longitudinal direction of the heater 300 (HB1 to HB7). To indicate the correspondence of these seven heat generating blocks HB1 to HB7, a composing element constituting each heat generating block is denoted with a reference sign, in which a number of the corresponding heat generating block is attached at the end, such as heat generating elements 302*a*-1 to 302*a*-7. This is the same for the heat generating element 302*b*, the conductors 301*a* and 301*b*, the conductor 303, and the electrode E3.

The surface protective layer 308 on the back surface layer 2 of the heater 300 is formed such that the electrodes E3-1 to E3-7, E4 and E5 are exposed. To each electrode, an electric contact (not illustrated) can be connected from the back surface side of the heater 300. Thereby, power can be supplied to each heat generating block independently. By dividing the heat generating block into the seven heat generating blocks like this, four heat generating regions AREA1 to AREA4 can be created. In Example 1, AREA1 is for A5 sized paper, AREA2 is for B5 sized paper, AREA3 is for A4 sized paper, and AREA4 is for Letter sized paper. Since the seven heat generating blocks can be controlled independently, a heat generating block, to which power is supplied, can be selected in accordance with the size of the recording paper P. The number of the heat generating regions and the number of the heat generating blocks are not limited to the numbers specified in Example 1. Further, the heat generating elements 302*a*-1 to 302*a*-7 and 302*b*-1 to 302*b*-7 in each heat generating block are not limited to a continuous pattern described in Example 1, but may be rectangular patterns with intervals.

On a sliding surface layer 1 of the heater 300 (on the surface of the substrate 305 at the opposite side to the surface on which the heat generating elements are disposed), thermistors T1-1 to T1-7 and thermistors T2-2 to T2-6 are disposed as temperature detecting elements to detect the temperature of each heat generating block of the heater 300. Each of the thermistors T1-1 to T1-7, which are mainly used for controlling the temperature of each heat generating block, is disposed at the center of each heat generating block (center of the substrate in the longitudinal direction). The thermistors T2-2 to T2-6 are edge thermistors for detecting the temperature of a non-paper passing region (edges) when recording paper, which is narrower than the heat generating region, is fed. Therefore, each of the thermistors T2-2 to T2-6 is disposed in a position closer to the outer side of each heat generating block with respect to the conveyance reference position X0, excluding the heat generating blocks on both ends in which the heat generating region is narrow. One end of each of the thermistors T1-1 to T1-7 is connected to the respective conductor ET1-1 to ET1-7 for detecting the resistance value of the thermistor, and the other end thereof is commonly connected to the conductor EG9. One end of each of the thermistors T2-2 to T2-6 is connected to the respective conductor ET2-2 to ET2-6, and the other end thereof is commonly connected to the conductor EG10. In this way, the width L of the heater 300 tends to increase as the number of thermistors and number of conductors increase.

On the sliding surface layer 2 of the heater 300, a surface protective layer 309, coated by glass having slidability, is disposed. The surface protective layer 309 is disposed, excluding both end portions of the heater 300, so as to create electrical contact in each conductor of the sliding surface layer 1.

Figure 4:
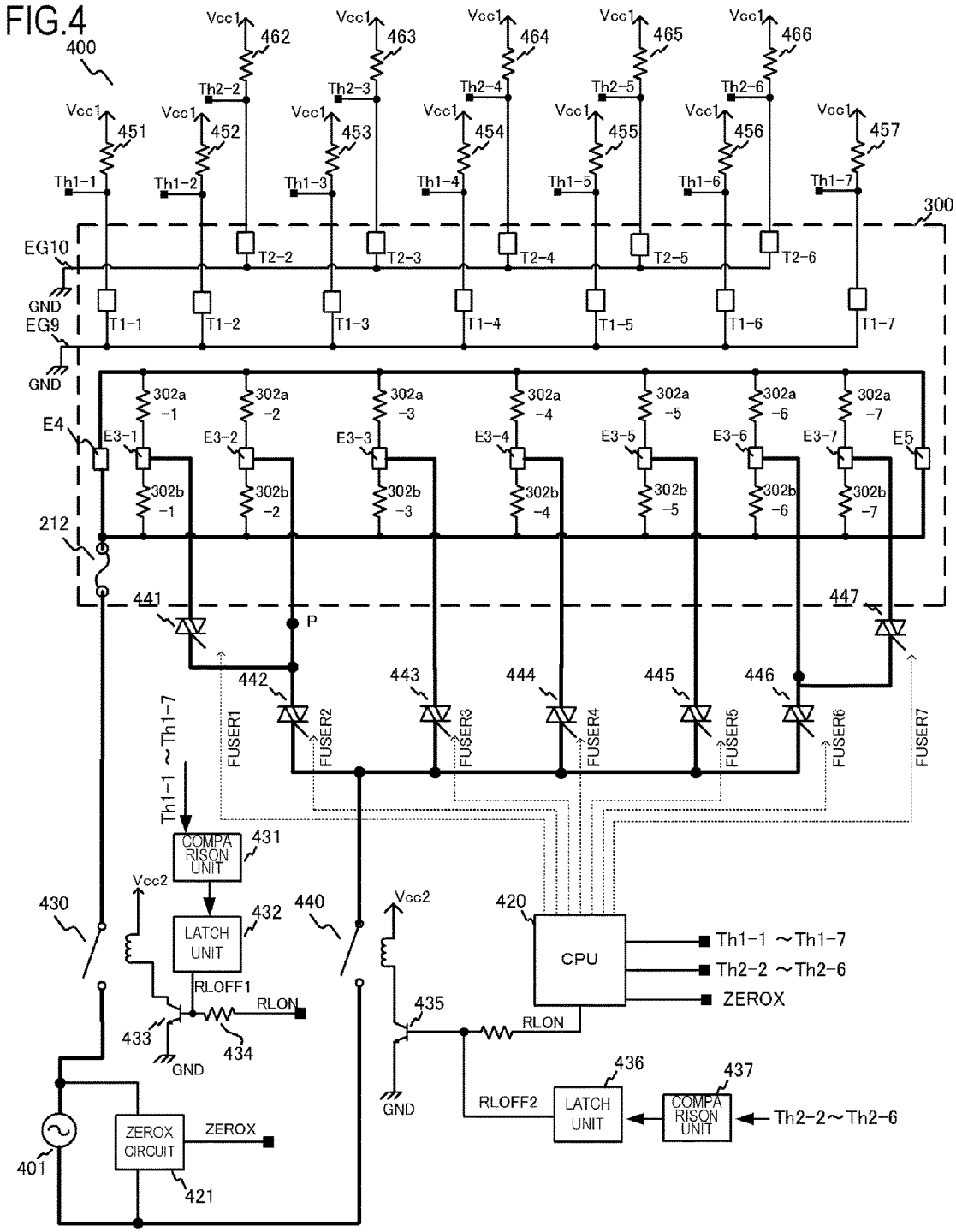
FIG. 4 is a control circuit diagram according to Example 1.

FIG. 4 is a circuit diagram depicting a control circuit 400 of the heater 300 of Example 1. A commercial alternating current (AC) power supply 401 is connected to the image forming apparatus 100. The power supply voltages Vcc1 and Vcc2 are direct current (DC) power supplies generated by an AC/DC convertor (not illustrated), which is connected to the AC power supply 401. The AC power supply 401 is connected to the heater 300 via relays 430 and 440 and triacs (semiconductor elements) 441 to 447. The triacs 441 to 447 are turned ON/OFF by control signals FUSER1 to FUSER7 from a central processing unit (CPU) 420. The drive circuits of the triacs 441 to 447 are not illustrated. Power supply to the plurality of heat generating elements can be selectively controlled by selectively controlling the triacs 441 to 447, which are a plurality of semiconductor elements, whereby a plurality of heat generating blocks, which are divided in the longitudinal direction, can be selectively heated independently.

The temperature detecting circuit of the thermistors will be described. The conductors EG9 and EG10 are connected to the ground potential. The voltages for the thermistors T1-1 to T1-7 and T2-2 to T2-6 shown in FIG. 3 are divided into voltages of Th1-1 to Th1-7 and Th2-2 to Th2-6 and voltages for the resistors 451 to 457 and 462 to 466, which are pulled up to Vcc1 respectively. The divided voltages are detected by the CPU 420 as Th1-1 to Th1-7 signals and Th2-2 to Th2-6 signals. Then the voltages are converted into temperature information by the information that is set in an internal memory of the CPU 420 in advance, whereby the temperature is detected.

In the internal processing, the CPU 420 calculates power to be supplied using proportion integral (PI) control, for example, based on the set temperature and the detected temperatures by the thermistors T1-1 to T1-7. The ON timings of the FUSER1 to 7 signals are generated by the CPU 420, based on the timing signal ZEROX synchronizing with the zero potential of the AC power supply 401 generated by a zero cross detecting unit 421. Based on the zero cross timing of the AC power supply 401, the detected temperatures are converted into the phase angle (phase control) and wave number (wave number control) corresponding to the power to be supplied, and the triacs 441 to 447 are controlled based on the control conditions.

Relays 430 and 440 and the protecting circuit will be described. The relays 430 and 440 are power interrupting units that are activated when the heater 300 overheats due to a failure, or the like.

An operation of the relay 430 will be described. When the CPU 420 sets an RLON signal to High, a transistor 433 turns ON, the current is supplied from the power supply Vcc2 to the secondary side coil of the relay 430, and the primary side contact of the relay 430 turns ON. When the CPU 420 sets the RLON signal to Low, the transistor 433 turns OFF, and current that flows from the power supply voltage Vcc2 to the secondary side coil of the relay 430 is interrupted, and the primary side contact of the relay 430 turns OFF. The resistor 434 is a resistor to limit the base current of the transistor 433. This operation is also the same for the relay 440 and the transistor 435.

The operation of a safety circuit using the relay 430 and the relay 440 will be described. When the detected temperature by any one of the thermistors T1-1 to T1-7 exceeds a predetermined value that is set, a comparison unit 431 activates a latch unit 432, and the latch unit 432 sets the RLOFF1 signal to Low, and latches the RLOFF1 signal. When the RLOFF1 signal becomes Low state, the transistor 433 maintains the OFF state even if the CPU 420 sets the RLON signal to High, and, therefore, the relay 430 can maintain the OFF state (safe state). In the same manner, when the detected temperature by any one of the thermistors T2-2 to T2-6 exceeds a predetermined value that is set, a comparison unit 437 activates a latch unit 436, and the latch unit 436 sets the RLOFF2 signal to Low, and latches the RLOFF2 signal.

A relationship between a configuration of the heater drive circuit using the triacs 441 to 447 and the number of thermistors will be described here. The triac 441 that drives the heat generating block HB1 is connected in series with the triac 442 that drives the adjacent heat generating block HB2. If only the triac 442 is driven, only the heat generating block HB2 is heated. If both of the triacs 441 and 442 are driven, the heat generating blocks HB1 and HB2 are heated. In this configuration, it is unlikely that only the heat generating block HB1 is heated. Since the triacs 441 and 442 are connected in series, in order to drive the heat generating block HB1, which is disposed on the outer side of the heat generating block HB2 in the longitudinal direction of the heater 300, the heat generating region can be selected depending on the paper size.

The printer of Example 1 includes the safety circuit using the thermistors, so that the heater 300 does not heat up to an abnormal temperature even if an abnormality occurs to the control of the heater 300 due to a malfunction of the CPU 420, or the like. In other words, the safety circuit is included so that even if one component does not function due to failure, the abnormality of the heater 300 is detected, and the relays 430 and 440 are turned OFF to protect the heater 300. In the heat generating block HB3, for example, two thermistors T1-3 and T2-3 are disposed. Further, a comparison unit 437 and a latch unit 436, to which the voltage signals Th1-3 and Th2-3 in accordance with the resistance values of these thermistors, are included. Because of these configurations, even if either one of the thermistors fails, the voltage signal from the other thermistor is inputted to the comparison unit 437 and the latch unit 436. Therefore the abnormal temperature relay 430 or 440 can be activated to protect the heater 300. In the heat generating block HB2, 4, 5 and 6 as well, two thermistors are disposed in the same manner. In the heat generating block HB1, on the other hand, only one thermistor (T1-1) is disposed. The triacs 441 and 442 are connected in series, however, so that the heat generating block HB2 is always heated whenever the heat generating block HB1 is heated. Therefore, unless a disconnection occurs in the heat generating block HB1 at point P indicated in FIG. 4, the heat generating block HB1 alone does not abnormally heat up. In other words, while the heat generating block HB1 is heated, the heat generating block HB2 is always heated. If the heat generating block HB1 abnormally heats up because of the failure of the thermistor T1-1, the heat generating block HB2 also abnormally heats up, and hence, the abnormal heat generating can be detected by the thermistor T1-2 and the thermistor T2-2 disposed in the heat generating block HB2. In other words, the temperature of the heat generating block HB1 can be managed using the thermistor T1-1 alone. This is the same for the heat generating block HB7, and a description thereof is omitted. Further, the heat generating regions of the heat generating blocks HB1 and HB7 are small, and hence, one thermistor is used for both the edge thermistor to detect the temperature of the non-paper passing region (edge) and the thermistor for temperature control.

As described above, according to Example 1, the heat generating block HB1, which is driven by the semiconductor element 441 in a subsequent stage of the semiconductor element 442 to drive the heat generating block HB2, is disposed at least in one of a plurality of heat generating blocks HB1 to HB7. Because of this configuration, the heater 300 can be protected even if the number of thermistors is decreased.

In Example 1, the triac 441 for driving the heat generating block HB1, which is located on the outer side (edge side) of the heat generating block HB2 in the longitudinal direction, is connected in series to the triac 442 for driving the heat generating block HB2. The configuration to which the present invention can be applied is not limited, however, to this configuration. For example, the triac 442 for driving the heat generating block HB2, which is located on the outer side (edge side) of the heat generating block HB3 in the longitudinal direction, may be connected in series to the triac 443 for driving the heat generating block HB3. By this configuration, the number of thermistors for detecting the temperature of the heat generating block HB2 can be less than the number of thermistors for detecting the temperature of other heat generating blocks.

Figure 5:
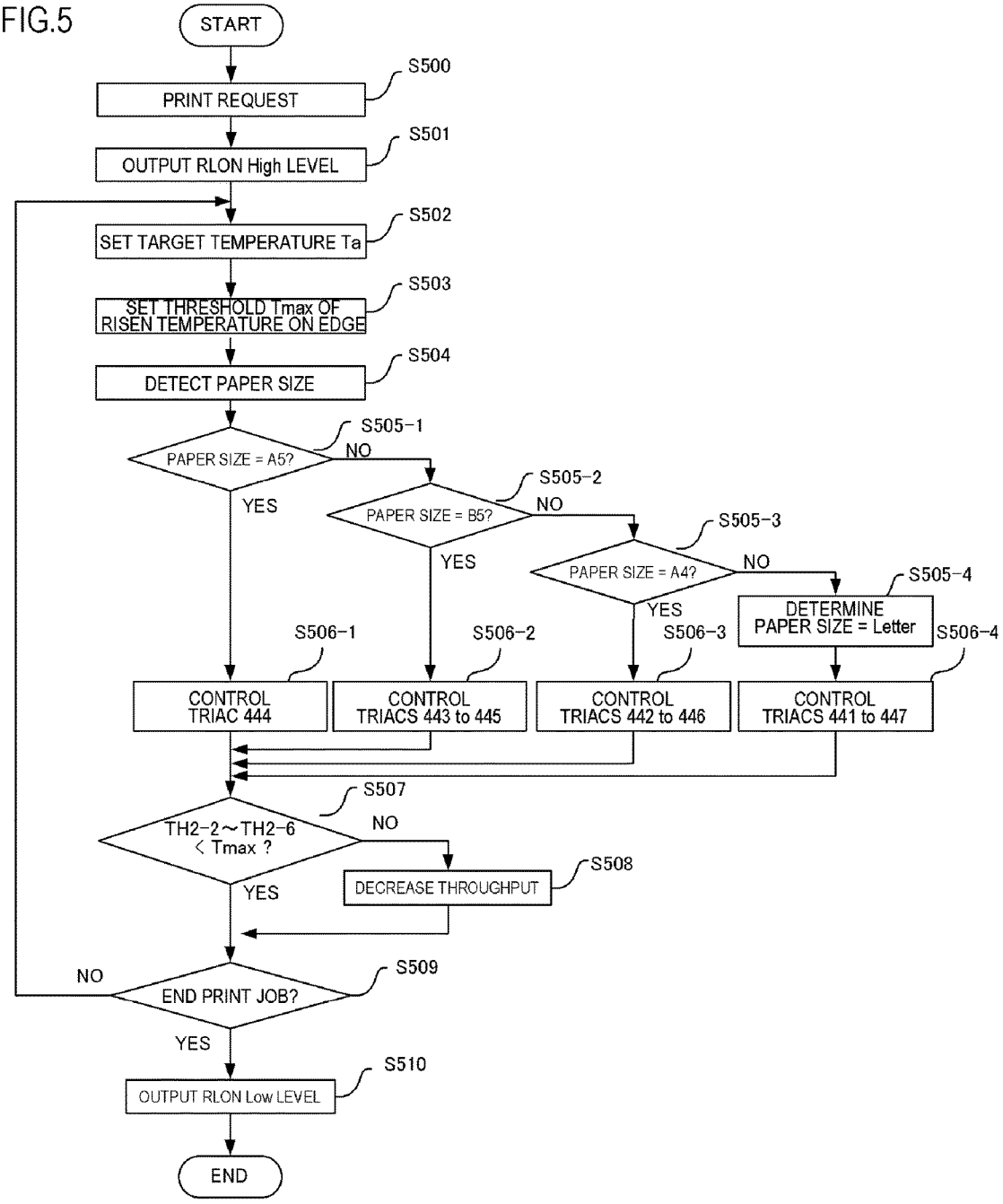
FIG. 5 is a control flow chart according to Example 1.

FIG. 5 is a control flow chart according to Example 1. When a print request is received in step S500, the following steps start. In step S501, the RLON signal is outputted at High level to turn the relays 430 and 440 ON. In step S502, the CPU 420 reads the target temperature Ta stored in the internal memory of the CPU 420 (not shown). In step S503, a critical temperature when the temperature of the non-paper passing portion rises (risen temperature on the edge) Tmax, is read from the internal memory. In step S504, a paper size sensor (not illustrated) in the paper feeding cassette 11 detects the size of the recording paper P that is set in the paper feeding cassette 11. In steps S505-1 to S505-4, the paper size is determined, and, in steps S506-1 to S506-4, a heat generating region (heating region), corresponding to each paper size, is determined, and a triac corresponding to the heat generating region is controlled. If the temperatures detected by the thermistors T2-2 to T2-6 (edge thermistors) exceed the critical temperature Tmax of the temperature rise in the non-paper passing portion in S507, the throughput is decreased in step S508, so as to prevent the failure of the fixing apparatus 200 caused by overheating. The steps from S502 to S508 are repeated until the print job ends in step S509, and, if the print job ends, the RLON signal is outputted at Low level in step S510, and the relays 430 and 440 are turned OFF.

As described above, the number of thermistors can be decreased in a heat generating block in which semiconductor elements to drive the heater are connected in series in two stages, and, therefore, the width L of the heater 300 can be decreased, and the fixing apparatus 200 can be downsized.

Example 2

Example 2 of the present invention will be described. A control circuit 700 and a heater 600 in Example 2 are different from the control circuit 400 described in Example 1 in terms of the heat generating regions, which are connected in two stages in series. A composing element of Example 2 that is the same as Example 1 is denoted with a same reference symbol, and a description thereof is omitted. Matters that are not explained particularly in Example 2 are the same as those in Example 1.

Figure 6A:
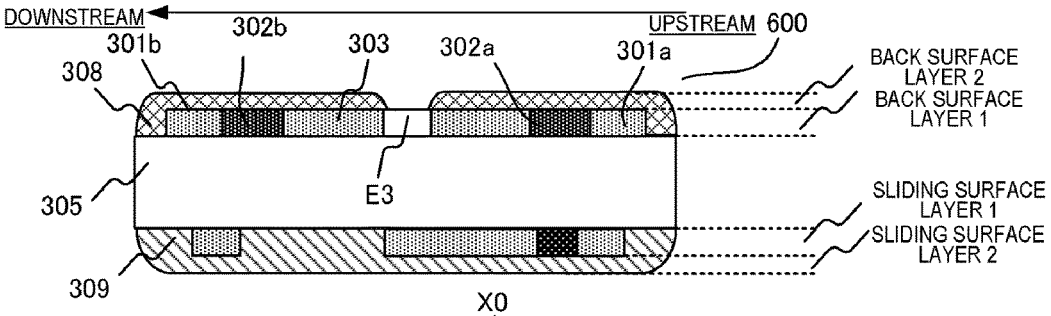
FIGS. 6A and 6B show a configuration of a heater according to Example 2.
Figure 6B:
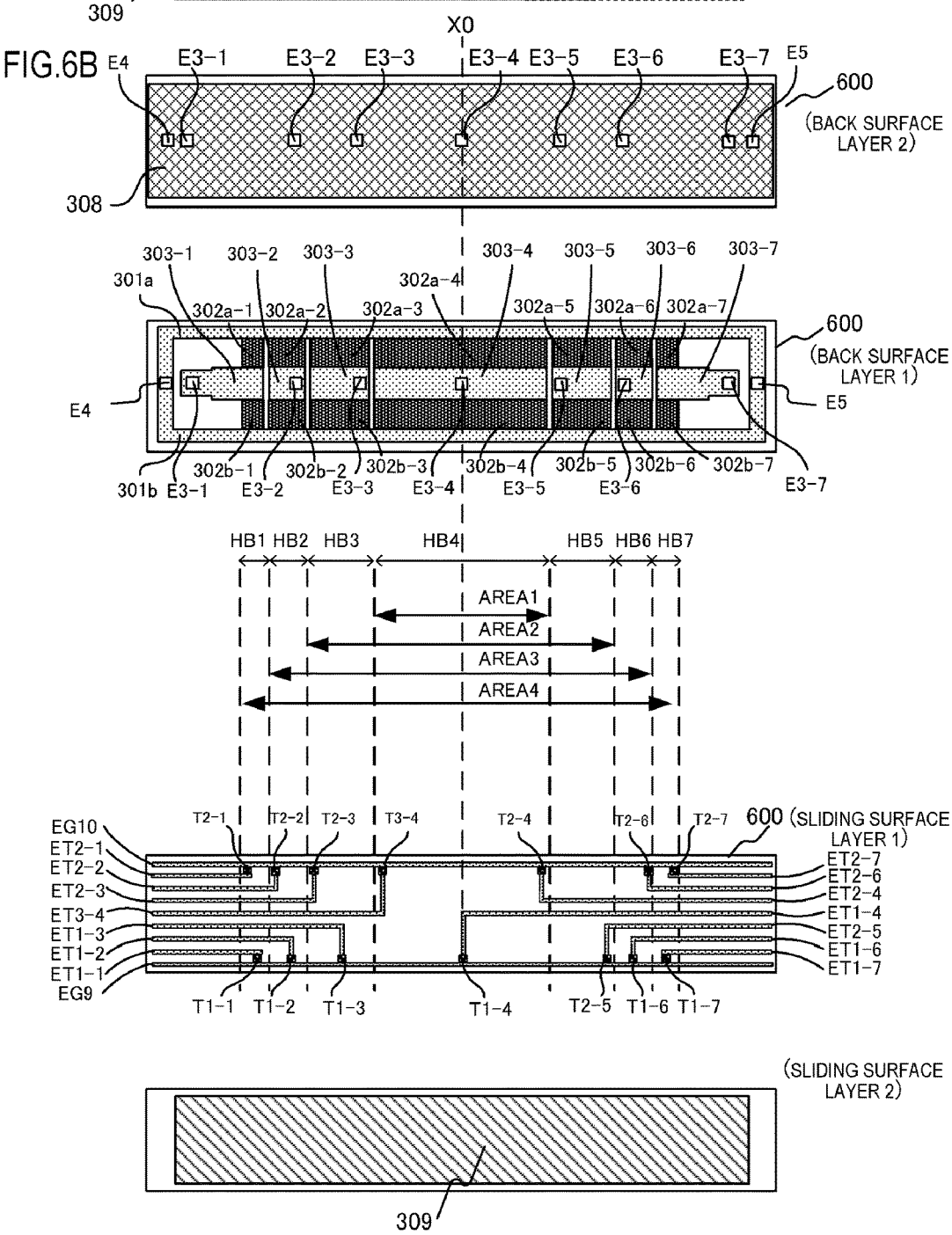

The configuration of the heater 600 according to Example 2 will be described with reference to FIGS. 6A and 6B. FIG. 6A is a cross-sectional view of the heater 600 (cross-sectional view of an area near the conveyance reference position X0 in FIG. 6B), and FIG. 6B is a plan view of each layer of the heater 600. As illustrated in FIG. 6B, in Example 2, in the sliding surface layer 1, the number of thermistors is one only in the heat generating block HB5, unlike Example 1. The reason for this is described with reference to FIG. 7. In Example 2, a thermistor T3-4 is added to the heat generating block HB4 of Example 1. This is for detecting the temperature rise in the non-paper passing portion when A5 sized paper is fed in the paper passing region AREA 1 in a state of being shifted to one side from the conveyance reference position X0, in the longitudinal direction of the heater 600.

Figure 7:
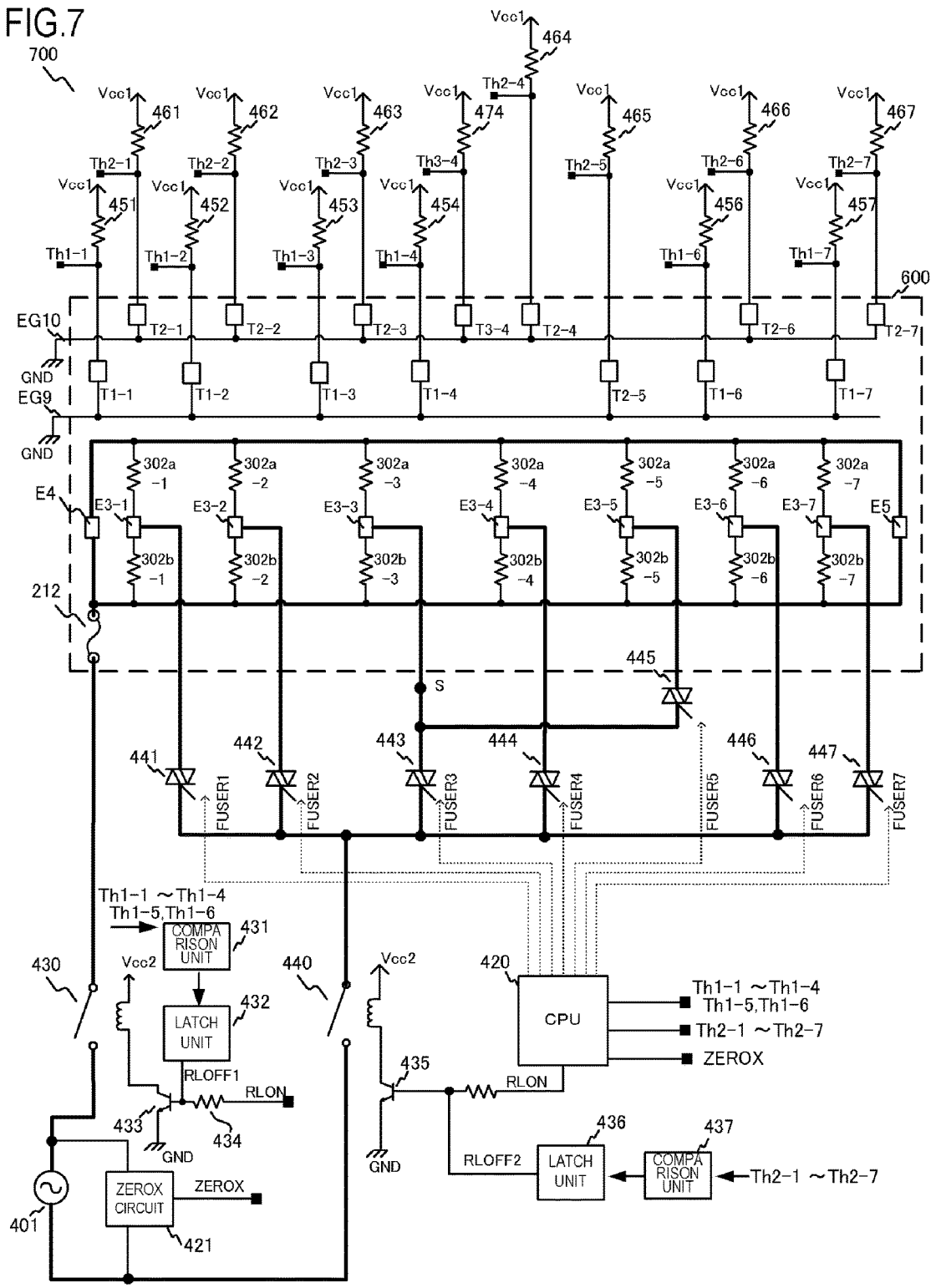
FIG. 7 is a control circuit diagram according to Example 2.

FIG. 7 is a circuit diagram depicting a control circuit 700 of the heater 600 of Example 2. In Example 2, the triac 445, for driving the heat generating block HB5, is connected in series to a subsequent stage of the triac 443 for driving the heat generating block HB3. The heat generating block HB3 and the heat generating block HB5 are symmetrical with respect to the conveyance reference position X0 in the longitudinal direction of the substrate 305, and hence, even when AREA2 is heated, the heat generating can be controlled without being affected by this driving configuration. By connecting the triacs 445 and 443 like this, even if a disconnection occurs at point S, the thermistor T2-5 can detect the abnormal heat generating of the heater 600 and stop the heater 600, just like Example 1, and, therefore, the number of thermistors can be decreased compared with other heat generating blocks.

Figure 8:
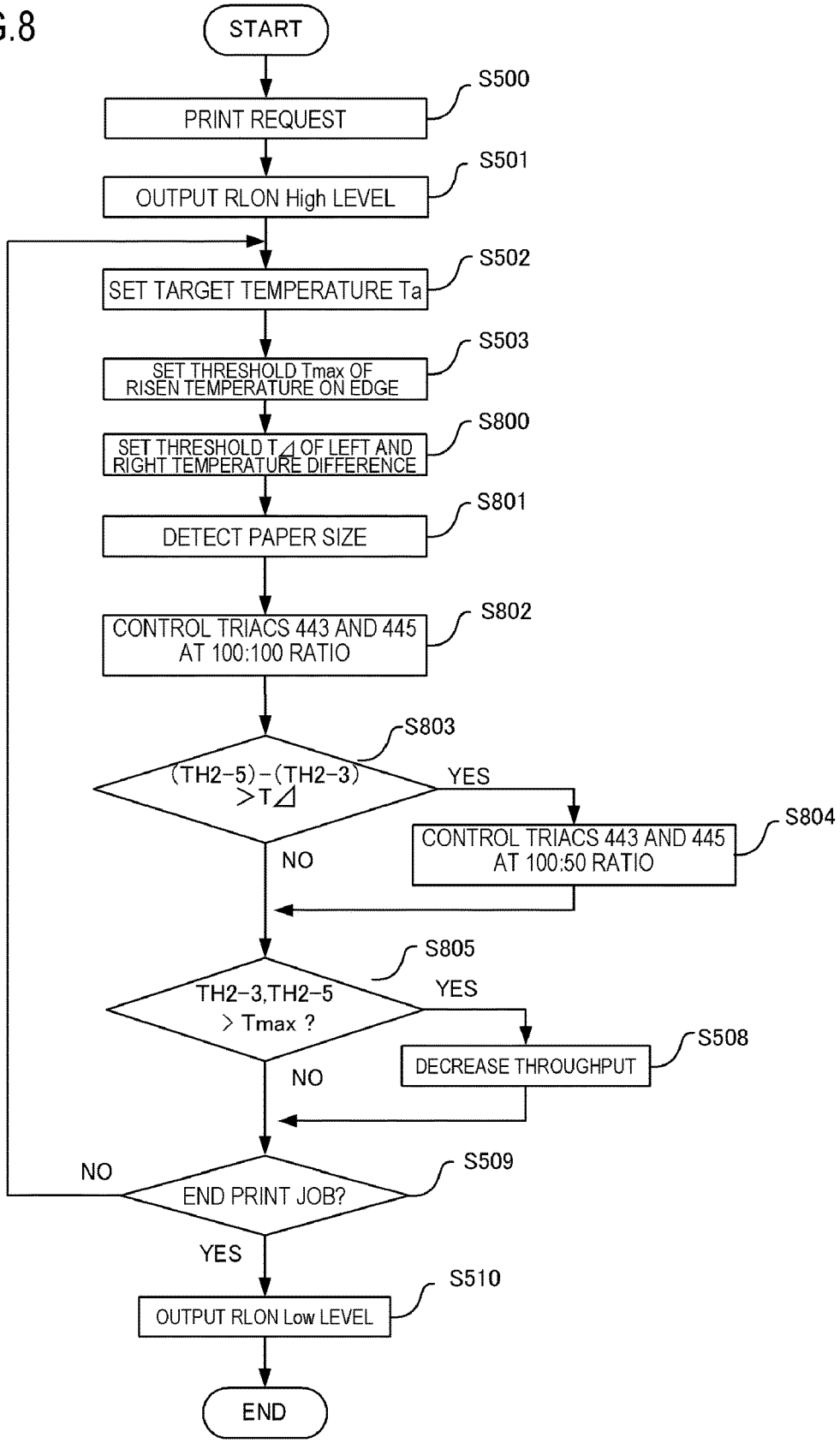
FIG. 8 is a control flow chart according to Example 2.

FIG. 8 is a control flow chart according to Example 2. The steps in S500 to S503 are the same as Example 1. In this flow chart, a case of detecting the B5 size, which corresponds to AREA2, in the paper size detection in step S801 will be described. When the triacs 443 to 445 corresponding to the B5 size are controlled, the power supply ratio between the triac 443 and the triac 445 is controlled to be 100:100 in step S802. In step S803, when the temperatures detected by the thermistors T2-3 and T2-5, which are edge thermistors of the heat generating blocks HB3 and HB5, are Th2-3 and Th2-5, it is checked whether the difference of Th2-3 and Th2-5 exceeds the temperature difference TΔ, which was set in advance in step S800. If the temperature of the thermistor T2-5 is high and the temperature difference exceeds TΔ, for example, it is regarded that the recording paper P was shifted toward the heat generating block HB3 in step S804, and the power supply ratio of the triacs 443 and 445 is decreased to 100:50, so as to suppress the temperature rise at the non-paper passing portion. In step S805, the temperature rise at the non-paper passing portion is detected, just like Example 1, and it is checked whether the detected temperature of the thermistors T2-5 and T2-3 exceed the threshold Tmax. If the detected temperatures exceed the threshold Tmax, the throughput is decreased in step S508, and control is continued. The above series of controls are repeated until the print job ends.

As described above, when a pair of heat generating blocks, which are disposed symmetrically with respect to the conveyance reference X0 of the recording paper, are connected in series and driven, the number of thermistors can be decreased just like Example 1, even if the heat generating blocks are not adjacent to each other.

Example 3

Example 3 of the present invention will be described. Example 3 is a modification of the drive configuration of Example 2, and the semiconductor element on the second stage, out of the semiconductor elements connected in series, is shorted. In Example 3, the recording paper P is not shifted because of the conveying guide (not illustrated), and hence, the semiconductor element in the second stage may be shorted without disposing the triac 445 in a subsequent stage, as in Example 2. A composing element of Example 3 that is the same as Examples 1 and 2 is denoted with a same reference symbol, and a description thereof is omitted. Matters that are not explained particularly in Example 3 are the same as those in Example 1 and Example 2.

Figure 9A:
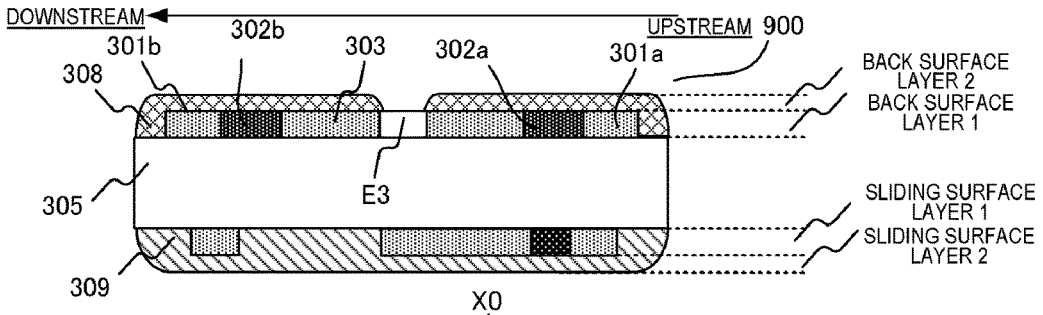
FIGS. 9A and 9B show a configuration of a heater according to Example 3.
Figure 9B:
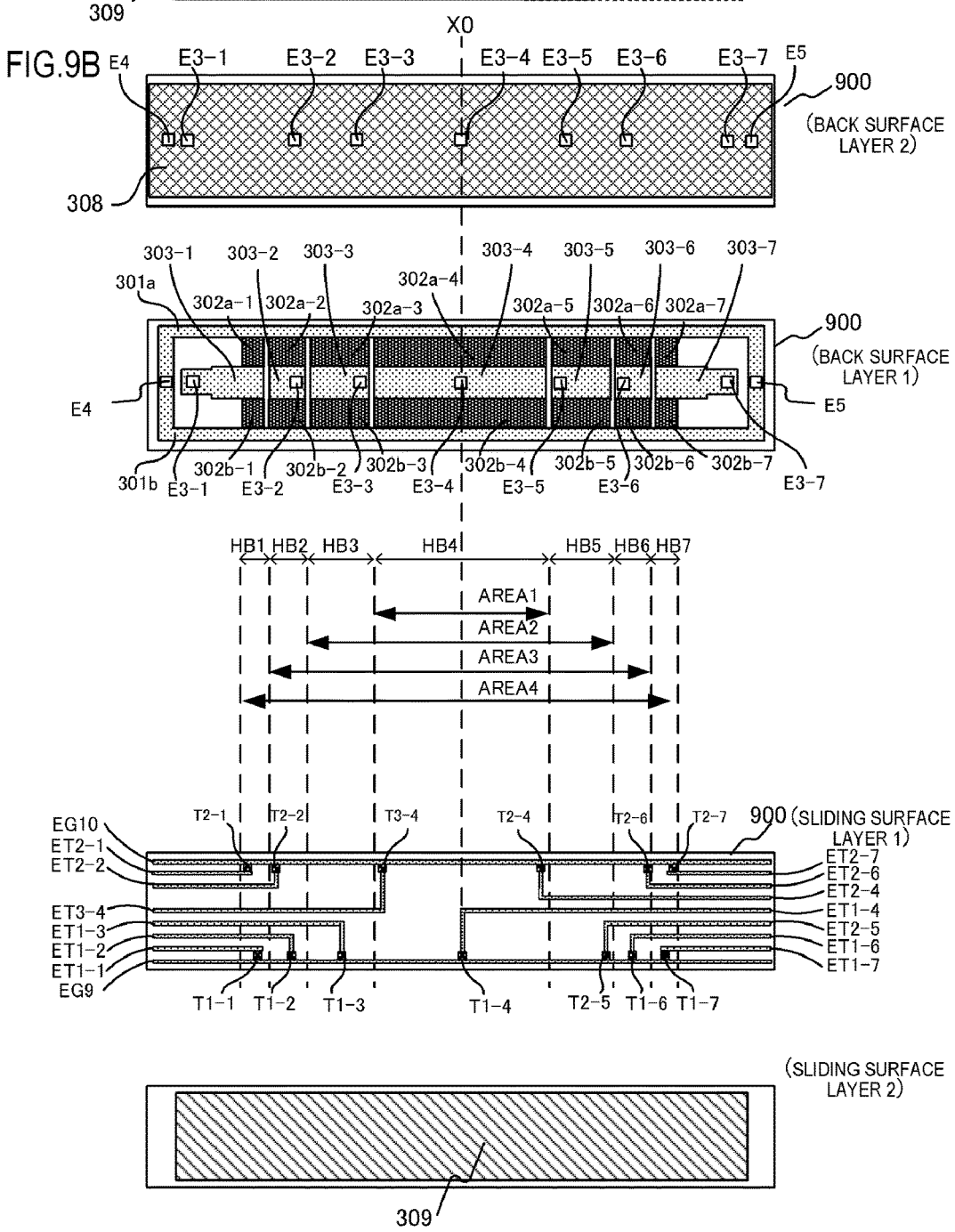

The configuration of a heater 900 according to Example 3 will be described with reference to FIGS. 9A and 9B. FIG. 9A is a cross-sectional view of the heater 900 (cross-sectional view of an area near the conveyance reference position X0 in FIG. 9B), and FIG. 9B is a plan view of each layer of the heater 900. As illustrated in FIG. 9B, the number of thermistors of the heat generating block HB3 is smaller by one than that of Example 2 on the sliding surface layer 1.

Figure 10:
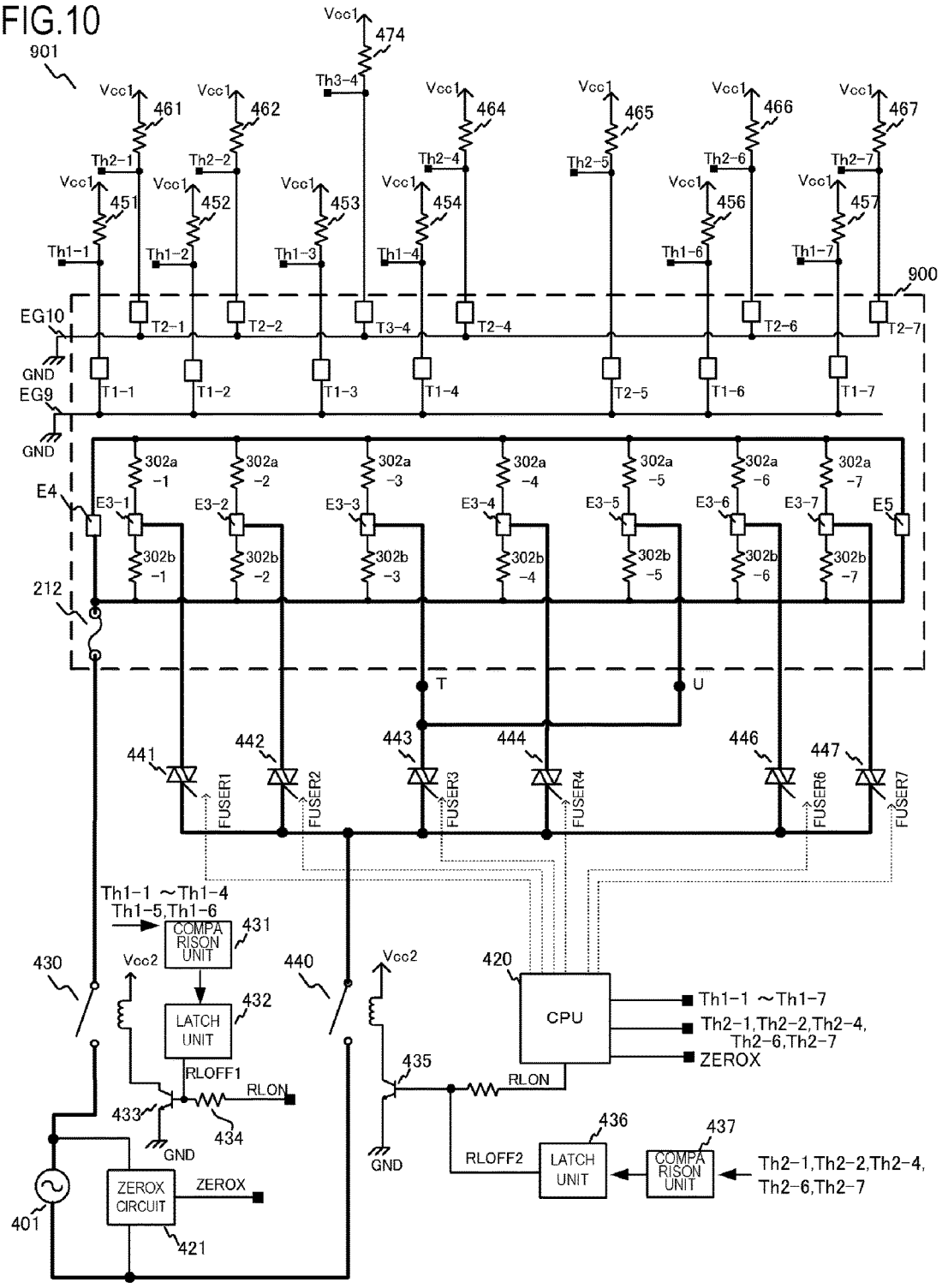
FIG. 10 is a control circuit diagram according to Example 3.

FIG. 10 is a circuit diagram depicting a control circuit 901 of the heater 900 of Example 3. Even if a disconnection occurs at point T, the thermistor T2-5 can detect the abnormal state and protect the heater 900. In the same manner, even if a disconnection occurs at point U, the thermistor T1-3 can protect the heater 900. In other words, even if the number of thermistors is less than that of the other heat generating blocks 1, 2, 4, and, 6 and 7, the abnormality state of the heater 900 can be detected, and the heater 900 can be protected.

As described above, the number of thermistors can be decreased, even in the configuration in which the semiconductor element in a subsequent stage, out of the semiconductor elements connected in series, is shorted, and, therefore, the width of the heater 900 can be decreased, and the fixing apparatus 200 can be downsized.

Further, in Example 3, the supply of power to the respective heat generating elements that heat the heat generating block HB3 and the heat generating block HB5, which are disposed symmetrically with respect to the conveyance reference position X0 of the recording material in the longitudinal direction of the substrate, is controlled by controlling a single triac 443. The configuration to which the present invention can be applied is not limited, however, to this configuration. For example, the supply of power to of the heat generating elements 302*a*-2 and 302*b*-2 for heat generating the heat generating block HB2 and the supply power to the heat generating elements 302*a*-6 and 302*b*-6 for heat generating the heat generating block HB6, may be controlled by controlling a single triac 442.

Example 4

Example 4 of the present invention will be described. A control circuit 904 of a heater 903 of Example 4 has a configuration combining Example 1 and Example 3. A composing element of Example 4 that is the same as Examples 1 to 3 is denoted with the same reference symbol, and a description thereof is omitted. Matters that are not explained particularly in Example 4 are the same as those in Examples 1 to 3.

Figure 11A:
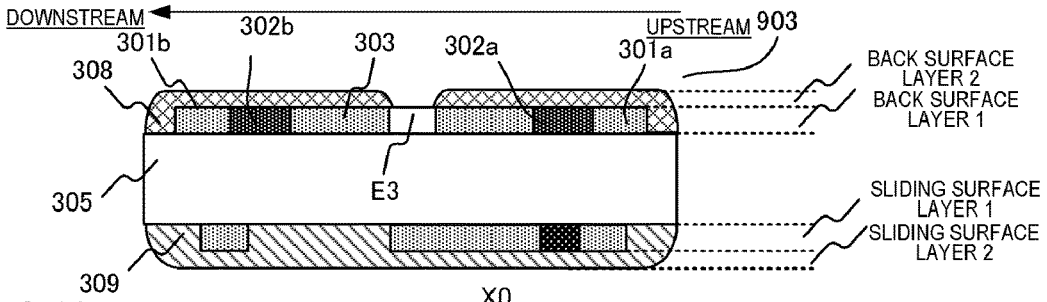
FIGS. 11A and 11B show a configuration of a heater according to Example 4.
Figure 11B:
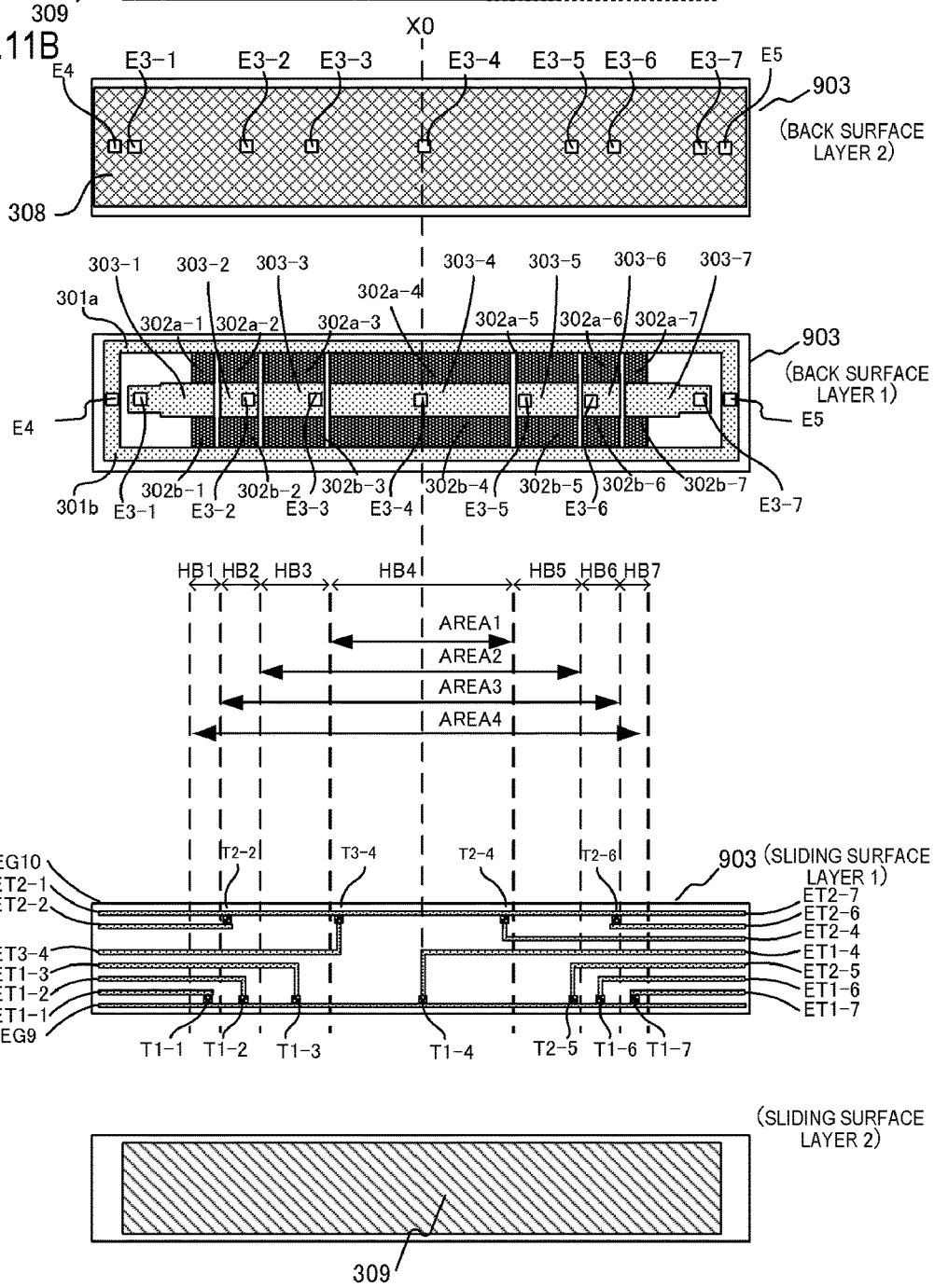

The configurations of the control circuit 904 of the heater 903 according to Example 4 will be described with reference to FIGS. 11A and 11B. FIG. 11A is a cross-sectional view of the heater 903 (cross-sectional view of an area near the conveyance reference position X0 in FIG. 9B), and FIG. 9B is a plan view of each layer of the heater 903. As illustrated in FIG. 11B, the heater 903 of Example 4 has less thermistors on the sliding surface layer 1 as compared with Example 1 and Example 3.

Figure 12:
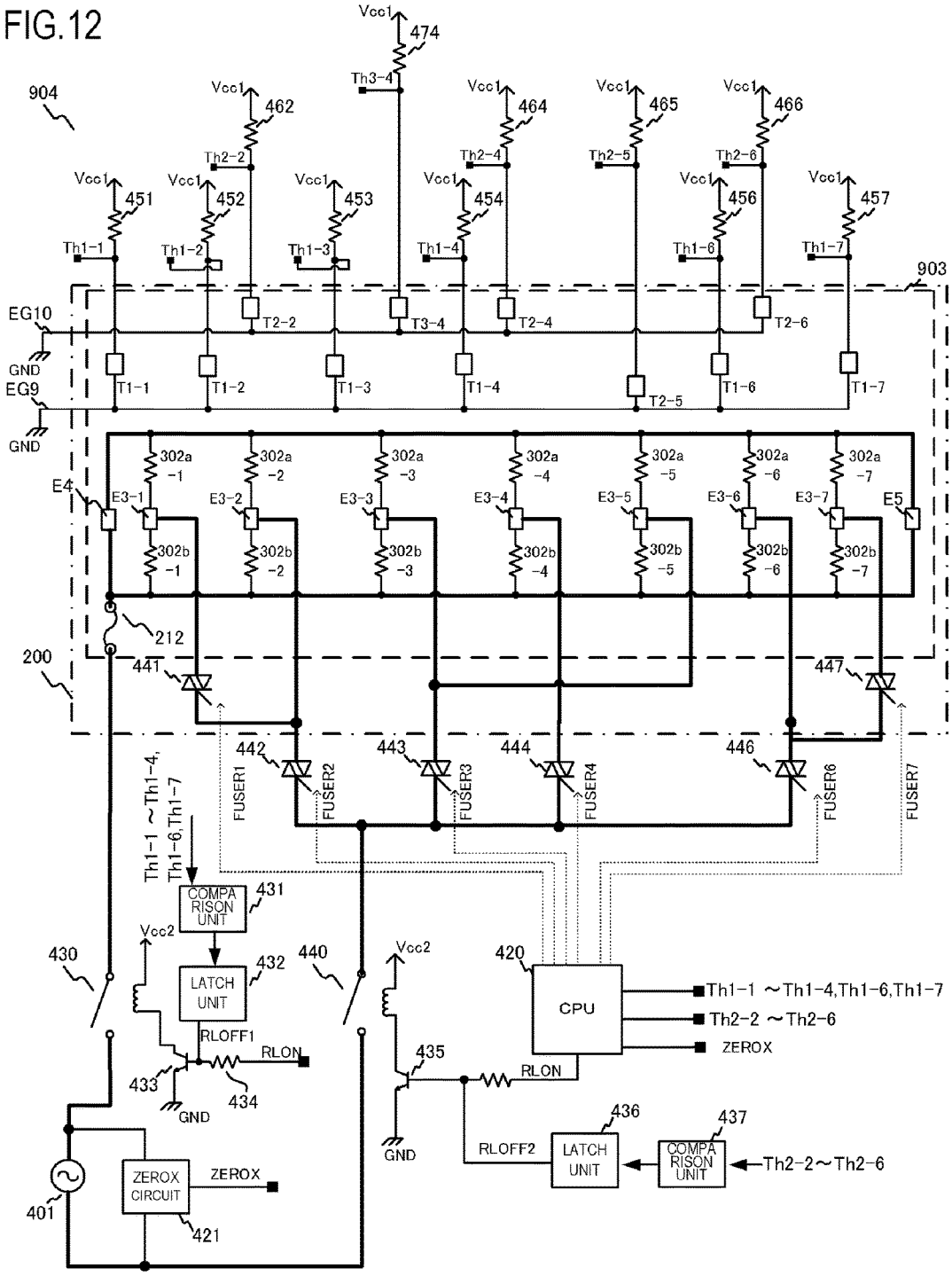
FIG. 12 is a control circuit diagram according to Example 4.

FIG. 12 is a circuit diagram depicting a control circuit 904 of the heater 903. The heat generating blocks HB1, HB3, HB5 and HB7 have one thermistor respectively based on the configuration described in Examples 1 and 3. Further, in Example 4, the triac 441 and the triac 447 are disposed in the fixing apparatus 200. Thereby the number of AC lines, which connect the control circuit 904 and the fixing apparatus 200, can be decreased, and hence, the number of pins of the connector and the number of wires can be decreased. In the same manner, the triacs 442 to 446 may also be disposed in the fixing apparatus 200.

As described above, the heater 904 can be protected in the abnormal state using less thermistors, since a plurality of heat generating blocks connected in series are driven. Therefore, the width of the heater 904 can be decreased, and the fixing apparatus 200 can be downsized. Further, the wires can be decreased by disposing the triacs inside the fixing apparatus 200, and, as a result, the image forming apparatus 100 can be downsized.

In Examples 1 to 4, the configuration is for protecting the heater from one failure, but the present invention is not limited to one failure, and may have a configuration that protects the heater from two or more failures. Further, the semiconductor elements that are connected in series are not limited to two stages, but may be three or more stages.

The configuration of each of the above examples may be combined as much as possible.

Example 5

Example 5 of the present invention will be described with reference to FIGS. 13A and 13B to FIGS. 15A and 15B. Example 5 is a configuration example in which the number of thermistors in HB1 and HB7 in the heater 300, described in Example 1, can be further decreased than the number in Example 1. The heater of Example 5 includes a control circuit 1001, in which a disconnection detecting portion 1002, which can detect the disconnection at point P, and a disconnection detecting portion 1003, which can detect the disconnection at point Q, are provided to the control circuit 400 of Example 1. A composing element of Example 5 that is the same as Examples 1 to 4 is denoted with a same reference symbol, and a description thereof is omitted. Matters that are not explained particularly in Examples 1 to 4.

Figure 13A:
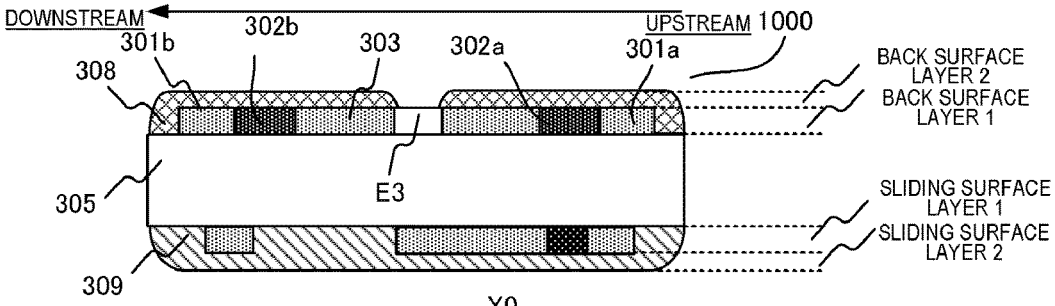
FIGS. 13A and 13B show a configuration of a heater according to Example 5.
Figure 13B:
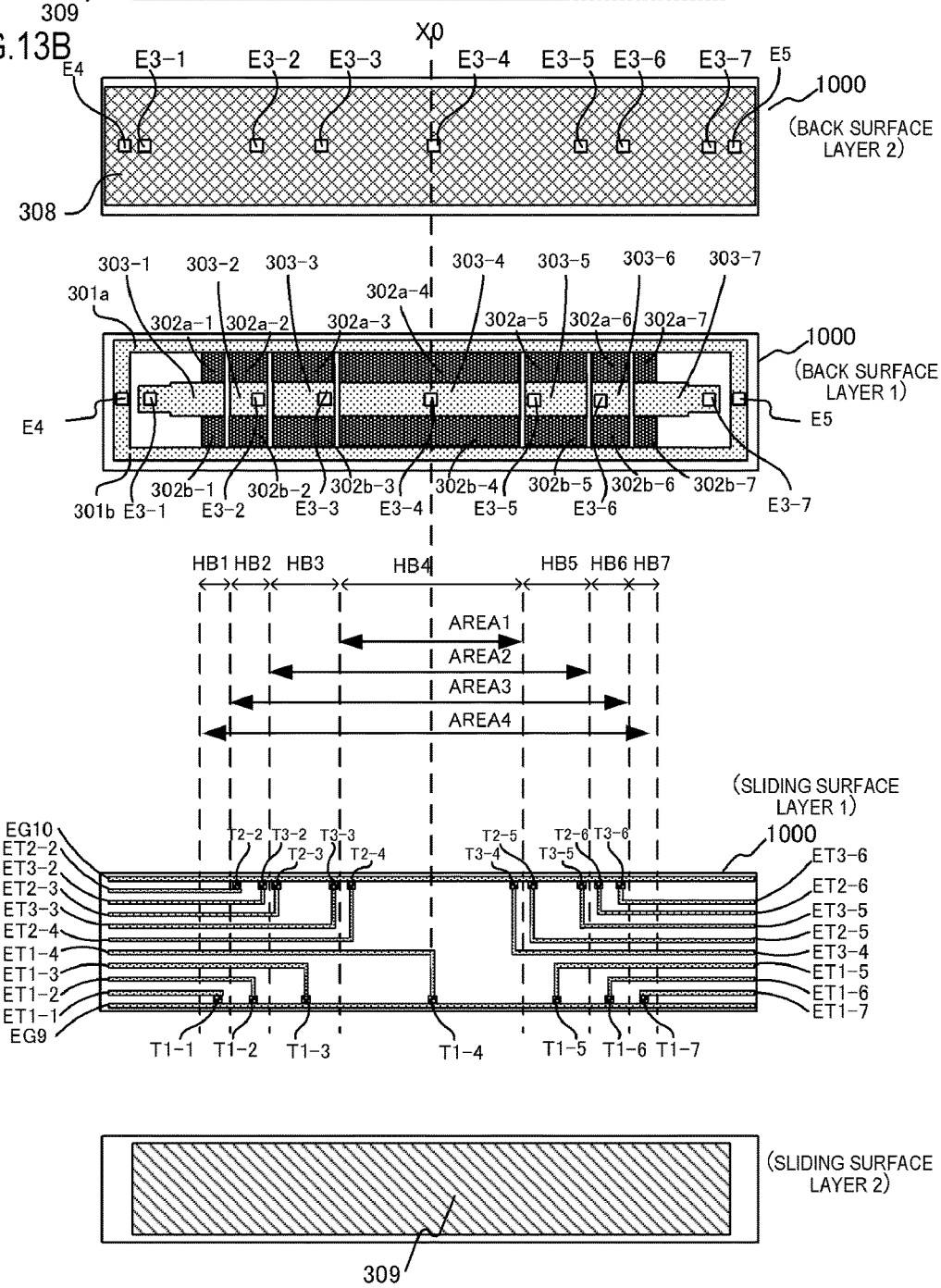

FIGS. 13A and 13B show a cross-sectional view and a plan view of a heater 1000. The number of thermistors in each of the heat generating blocks HB2 to HB6 is three, which is one more compared with Example 1, on the sliding surface layer 1 in FIG. 13B. If there are three thermistors in each heat generating block, the abnormality of the heater 1000 can be detected even if two components fail and cannot function. On the other hand, the number of thermistors in HB1 and HB7 is one, which is two less than the other heat generating blocks. The reason for this arrangement will be explained with reference to FIG. 14.

Figure 14:
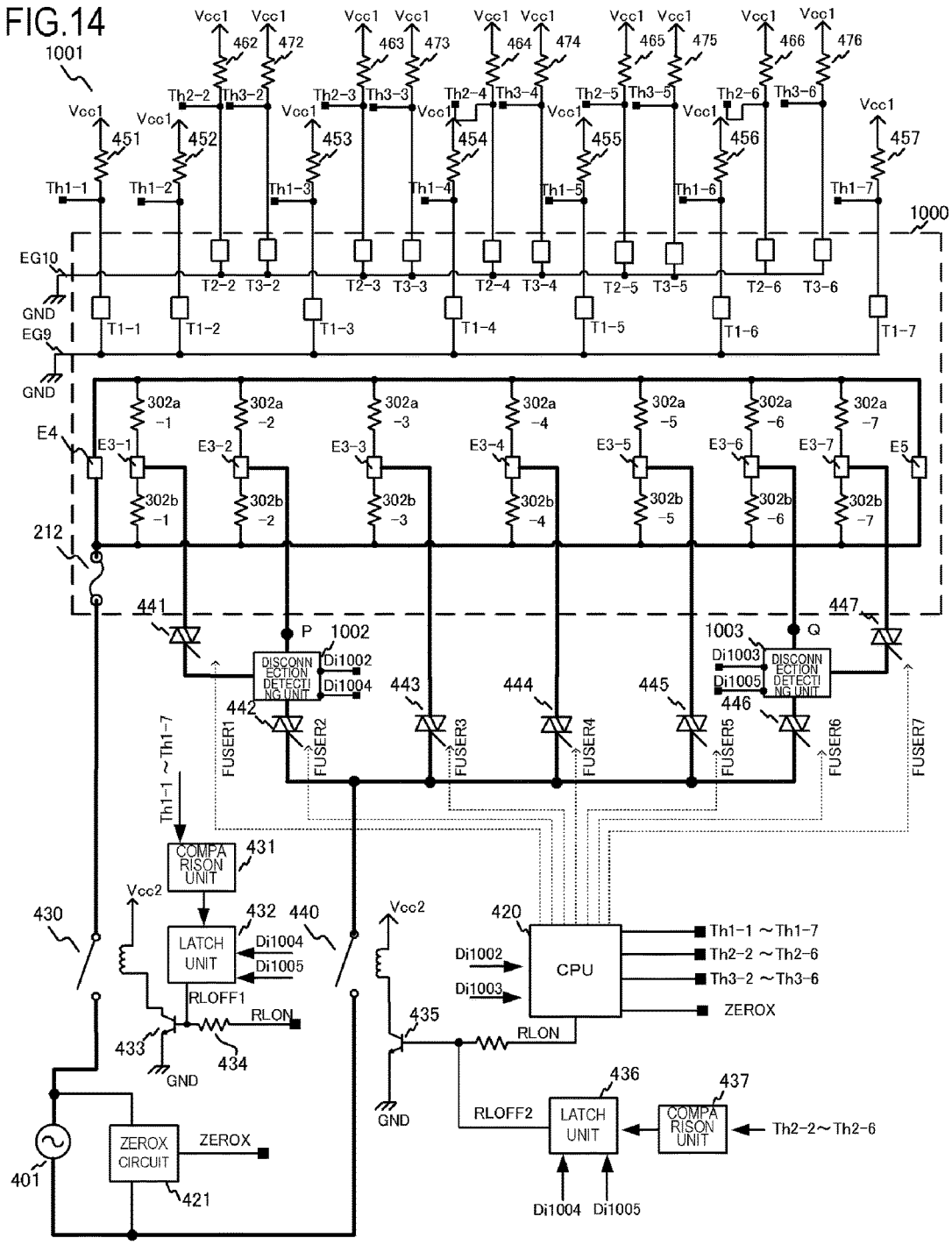
FIG. 14 is a control circuit diagram according to Example 5.

FIG. 14 is a circuit diagram depicting the control circuit 1001 of the heater 1000 in Example 5. The voltages applied to all the thermistors T1-1 to T1-7, T2-2 to T2-6 and T3-2 to T3-6 in FIG. 14 are all divided by the resistors 451 to 457, 462 to 466 and 472 to 476 pulled up to Vcc1 respectively. The divided voltages are detected by the CPU 420 as Th1-1 to Th1-7 signals, Th2-2 to Th2-6 signals and Th3-2 to Th3-6, and the temperature is detected. In Example 5, the disconnection detecting portion 1002 and the disconnection detecting portion 1003 are disposed so as to detect the disconnection at point P and point Q. The detected signal Di1002, Di1003, Di1004, and Di1005 of each disconnection detecting portion 1002 and 1003 are connected to the latch units 432 and 436 or the CPU 420. When a disconnection is detected, the disconnection detecting portion 1002 outputs the disconnection detecting signals Di1002 and Di1004, and the disconnection detecting portion 1003 outputs the disconnection detecting signals Di1003 and Di1005. When Di1004 and Di1005 are output, the latch units 432 and 436 are activated and set the RLOFF1 signal and RLOFF2 signal to Low, latch these signals, and turn the relays 430 and 440 OFF. When Di1002 and Di1003 are output, the CPU 420 outputs the FUSER1 to FUSER7 signals so that the triacs 441 to 447 are turned OFF. The internal circuits of the disconnection detecting portion 1002 and the disconnection detecting portion 1003 will be described with reference to FIGS. 15A and 15B.

Here, the relationship between the disconnection detection and the number of thermistors, which is a characteristic of Example 5, will be described. In Example 5, just like Example 1, the triacs 441 and 447, which drive the heat generating blocks HB1 and HB7, are connected to the triacs 442 and 446 in series, which drive the adjacent heat generating blocks HB2 and HB6 respectively. Therefore, unless one failure, in which disconnection occurs at point P and point Q, is generated, the heat generating blocks HB1 and HB7 alone do not abnormally heat up. Therefore, the number of thermistors in HB1 and HB7 can be decreased by one, compared with the other heat generating elements, just like Example 1. Further, in Example 5, the disconnection detecting portions 1002 and 1003, for detecting whether the disconnection occurred at point P and point Q, are included. Therefore, the heat generating blocks HB1 and HB7 alone will never abnormally heat up, unless a first failure in which disconnection occurs at points P and Q, and a second failure in which the disconnection detecting portions fails, are generated. Hence, the number of thermistors in HB1 and HB7 can be decreased by two, compared with the other heat generating elements.

Figure 15A:
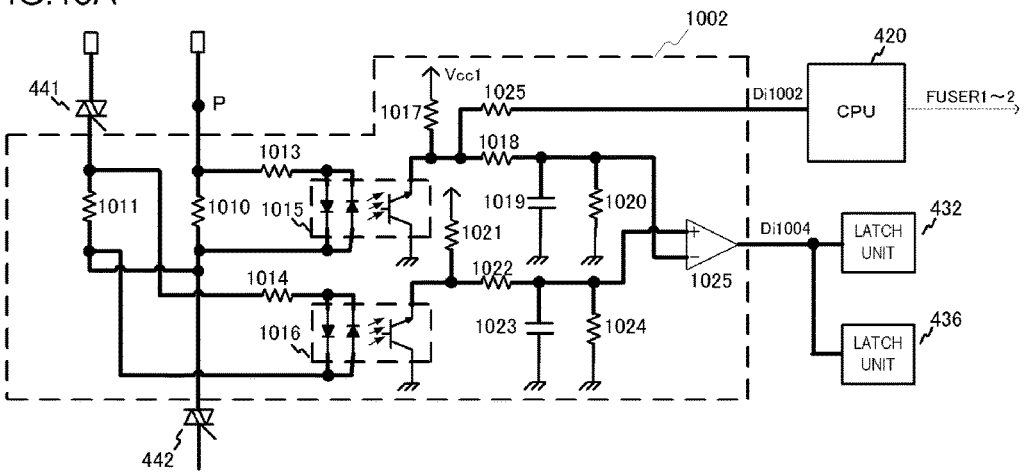
FIGS. 15A and 15B show diagrams for explaining a disconnection detecting portion according to Example 5.
Figure 15B:
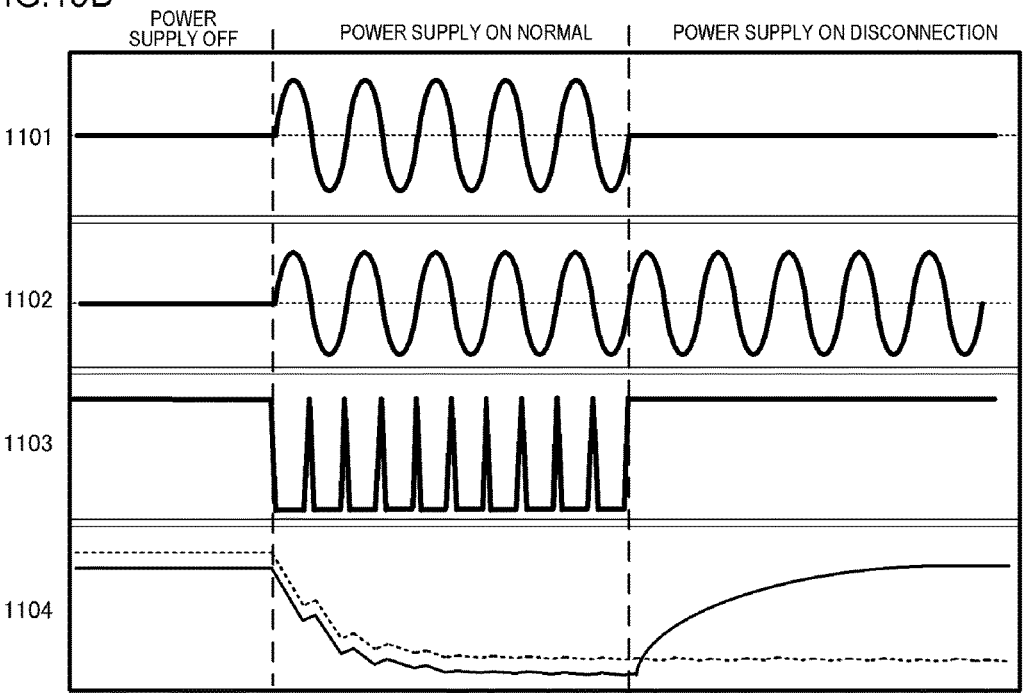

FIGS. 15A and 15B show an internal circuit of the disconnection detecting portion 1002 shown in FIG. 14. The internal circuit of the disconnection detecting portion 1003 is the same as that of the disconnection detecting portion 1002, and hence, a description thereof is omitted. FIG. 15A is a diagram depicting a circuit in which the signal Di1002, output from the disconnection detecting portion 1002, is connected to the CPU 420, and the signal Di1004 is connected to the latch units 432 and 436. Inside the disconnection detecting portion 1002, a detection resistor 1010 is connected near point P, as a second current detecting portion to detect the current that flows through point P. Further, a resistor 1013 and an AC coupler 1015, which propagates a signal detected by the detection resistor 1010 to the secondary side, are connected in parallel with the detection resistor 1010. Furthermore, inside the disconnection detecting portion 1002, a detection resistor 1011 is disposed as a first current detecting portion so that the current to the triac 441 can be detected. Also in parallel with the detection resistor 1011, a resistor 1014 and an AC coupler 1016, which propagates the signal detected by the detection resistor 1011 to the secondary side, are connected. The current path to supply current to the heat generating resistors 302*a*-2 and 302*b*-2 branches in the middle of the line connecting the triac 442 and the heat generating resistors 302*a*-2 and 302*b*-2, and is connected to the heat generating resistors 302*a*-1 and 302*b*-1 via the triac 441. In other words, the first current path, which supplies the current from the branch point to the heat generating resistors 302*a*-1 and 302*b*-1 located downstream of the branch post, and the second current path, which supplies the current from the branch point to the heat generating resistors 302*a*-2 and 302*b*-2 located downstream of the branch point, are branched from the third current path located upstream of the branch point.

The secondary side of the AC coupler 1015 is connected to the power supply Vcc1 via a pull up resistor 1017, and is then connected to the CPU 420 via a damping resistor 1025. When AC current is supplied to point P, AC voltage is applied to both ends of the detection resistor 1010, and the applied voltage signal is transferred to the secondary side via the AC coupler 1015. Here, the AC photocoupler is used for the AC coupler 1015 to transfer the signal of the full wave AC current to the secondary side, but a regular photocoupler may be used if only a signal of a half wave current is transferred. The signal transferred to the secondary side becomes a pulse signal, and is outputted to the CPU 420 as the disconnection detecting signal Di1002. The CPU 420 determines that disconnection occurred if the pulsed disconnection detection signal Di1002 from the disconnection detecting portion 1002 is not detected, even if the FUSER1 signal is turned ON and the triac 442 is turned ON, and that disconnection did not occur if the pulsed disconnection signal Di1002 is detected. When the CPU 420 determines that disconnection occurred, the FUSER1 and FUSER2 are turned OFF to interrupt power being supplied to the triacs 441 and 442. The waveforms will be described in detail with reference to FIG. 15B. The pulse signals transferred to the secondary side by the AC coupler 1015 and the AC coupler 1016 pass through the resistors 1018 and 1022 respectively, smoothed by the capacitors 1019 and 1023 and resistors 1020 and 1024, and connected to the comparator 1025. When the current is flowing in the detection resistor 1011, even if current is not flowing in the detection resistor 1010, it is likely that the route passing through point P is more likely disconnected. In this case, in FIG. 15B, the voltage at the negative (−) terminal of the comparator 1025 exceeds the voltage at the positive (+) terminal, the output Di1004 signal becomes LOW, and the latch units 432 and 436 are activated. The waveforms will be described in detail with reference to FIG. 15B.

FIG. 15B is a waveform chart depicting the operation of the circuit in FIG. 15A. A waveform 1101 indicates the voltage detected by the detection resistor 1010, a waveform 1102 indicates the voltage detected by the detection resistor 1011, and a waveform 1103 indicates the Di1002 signal output from the disconnection detecting portion 1002. The solid line of waveform 1104 indicates the voltage that is applied to the − terminal of the comparator 1025, and the dotted line thereof indicates the voltage that is applied to the + terminal of the comparator 1025. When the triac 442 is in the OFF state and power is OFF, the voltage is not generated (0V) at the detection resistor 1010, and, as a result, the transistor of the secondary side AC coupler 1015 is not activated. Therefore, the Di1002 signal becomes as indicated by the waveform 1103, and the voltage is pulled up to Vcc1. Further, when the triac 442 is turned ON and power is turned ON, voltage is generated at the detection resistor 1010, as indicated by the waveform 1101. As a result, the transistor of the secondary side AC coupler 1015 is activated, and makes the Di1002 signal LOW, and, therefore, the output Di1002 signal becomes the pulsed signal, as indicated by the waveform 1103. The CPU 420 can determine whether the current is supplied to the detection resistor 1010 or not, by detecting this pulsed waveform. When the disconnection is generated at point P, voltage is not generated at the detection resistor 1010, even if the triac 442 is turned ON, and hence, the waveform 1101 and the waveform 1103 indicate the same waveform as the waveform when power is OFF. Therefore, when the waveform 1103 is not the pulsed waveform, even if the triac 442 is turned ON and power is ON, by the CPU 420, it can be determined that disconnection is generated at point P, and the power of the triac 442 can be turned OFF.

When the triac 442 is in the OFF state and power is OFF, the transistor of the secondary side AC coupler 1015 is not activated. Therefore, the voltage at the − terminal of the comparator 1025 becomes a constant voltage that is determined by the voltage division by the resistors 1017, 1018, and 1020, as indicated by the solid line of the waveform 1104. In the same manner, the voltage is not generated at the detection resistor 1011, and hence, the voltage at the + terminal of the comparator 1025 also becomes a constant voltage that is determined by the voltage division by the resistors 1021, 1022, and 1024, as indicated by the dotted line of the waveform 1104. Here, the resistance values of the resistors 1017, 1018, and 1020 and the resistors 1021, 1022, and 1024 are set so that the voltage at the + terminal is greater than the voltage at the − terminal. Since the voltage at the + terminal is greater than the voltage at the − terminal, the output of the comparator 1025 becomes the open collector output, and the latch unit does not perform the latch operation. When the triac 442 is turned ON and power is turned ON, a voltage is generated at the detection resistor 1010, as indicated by the waveform 1101. As a result, the transistor of the secondary side AC coupler 1015 is activated, and the voltage at the − terminal of the comparator 1025 gradually decreases, as indicated by the solid line of the waveform 1104. Further, when the triac 441 is turned ON and power is turned ON, voltage is generated at the detection resistor 1011, as indicated by the waveforms 1102. Hence, the voltage at the + terminal of the comparator 1025 gradually decreases, as indicated by the dotted line of the waveform 1104. Here, the resistance values of the detection resistors 1010 and 1011 have been adjusted so that the voltage at the + terminal is greater than the voltage at the − terminal. Since the voltage at the + terminal is greater than the voltage at the − terminal, the output of the comparator becomes the open collector output, and the latch unit does not perform the latch operation. When the disconnection is generated at point P, the voltage is not generated at the detection resistor 1010 even if the triac 442 is turned ON, and hence, the transistor of the secondary side AC coupler 1015 is not activated. Therefore, the voltage at the − terminal gradually increases, as indicated by the solid line of the waveform 1104. Since the triac 441 is continuously ON even if disconnection is generated at point P, the voltage at the + terminal remains in the power ON state, as indicated by the dotted line of the waveform 1104. As a result, the voltage at the − terminal of the comparator eventually exceeds the voltage at the + terminal after the disconnection at point P, as indicated by the waveform 1104. Then, the output of the comparator becomes LOW, whereby the latch units 432 and 436 are activated.

As described above, according to Example 5, in the heat generating blocks HB1 and HB2, which are driven by the semiconductor elements in subsequent stages of the semiconductor elements to drive the heat generating blocks HB2 and HB6, the disconnection detecting portions, to detect disconnection in HB2 and HB6, are disposed. Thereby, even if the number of thermistors in the heat generating blocks HB1 and HB2 is less than the other heat generating blocks, the heater 300 can be protected even when two failures occur.

Example 6

Example 6 of the present invention will be described with reference to FIGS. 16A and 16B. Example 6 is a configuration in which the disposed position of the detection resistor 1012 and the connection position of Di1002 are different in the circuit of the disconnection detecting portion 1002 described in FIG. 15A of Example 5. The other configuration is the same as Example 5. A composing element of Example 6 that is the same as Examples 1 to 5 is denoted with the same reference symbol, and a description thereof is omitted. The rest is the same as Examples 1 to 5.

Figure 16A:
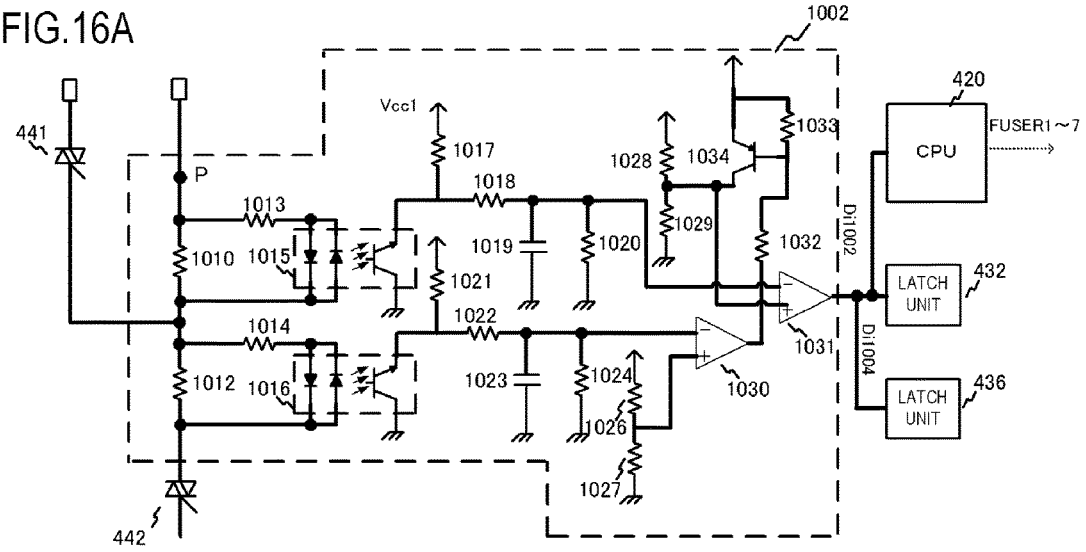
FIGS. 16A and 16B show diagrams for explaining a disconnection detecting portion according to Example 6.

FIG. 16A is a diagram depicting the disconnection detecting portion 1002, and a current detection resistor 1010 to detect current that flows through point P is connected near point P. Further, in FIG. 16A a detection resistor 1012 (third current detecting portion) is disposed immediately after the triac 442, that is, on the third current path before branching into the first current path and the second current path, so that whether the current is supplied from the triac 442 or not can be determined. In each of the detection resistors 1010 and 1012, the AC couplers 1015 and 1016 are connected in parallel, and the detection signal transferred to the secondary side is smoothed by the capacitors 1019 and 1023 and the resistors 1020 and 1024, and are connected to comparators 1030 and 1031, respectively. The output of the comparator 1030 is connected to the + terminal of the comparator 1031 via a transistor 1034 and resistors 1032 and 1033.

When the current is not flowing in the detection resistor 1010, even when the current is flowing in the detection resistor 1012, it is likely that the route passing through point P is disconnected. In this case, in FIG. 16A, the voltage at the – terminal of the comparator 1031 exceeds the voltage at the + terminal, the output Di1004 signal becomes LOW, and the latch units 432 and 436 are activated. At this time, the output of the Di1002 signal, which is connected to the CPU 420, also becomes LOW. When the Di1002 signal becomes LOW, even if the triac 442 is ON, the CPU 420 determines that disconnection is generated at point P, and turns FUSER1 and FUSER2 OFF so as to interrupt power supply to the triacs 441 and 442. The waveforms will be described in detail with reference to FIG. 16B.

Figure 16B:
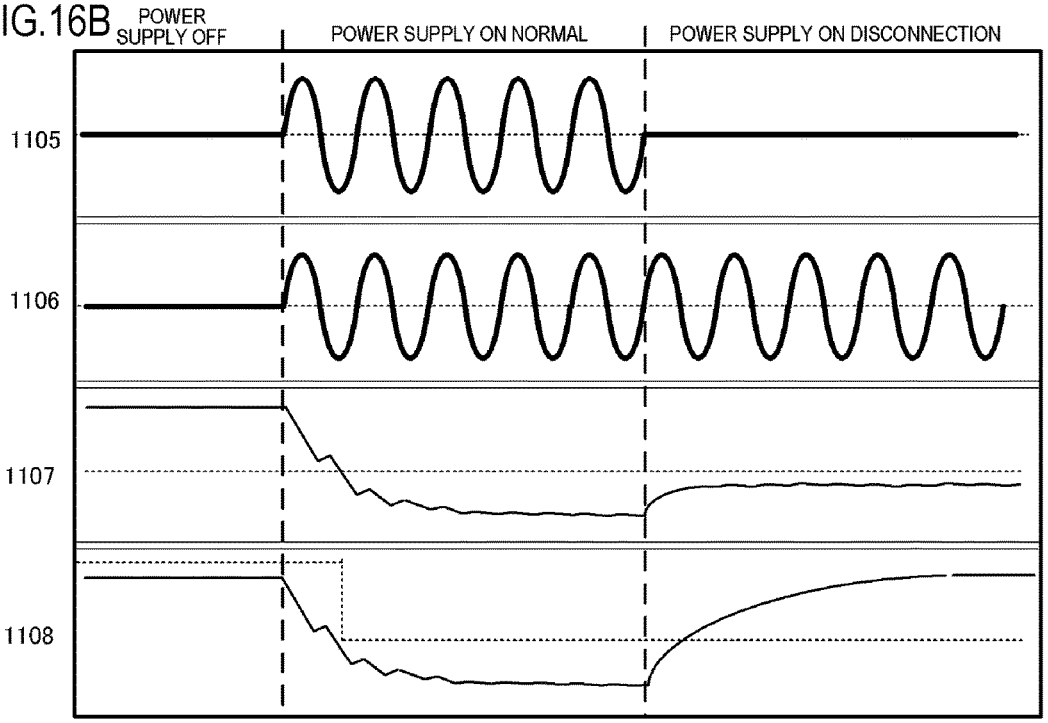

FIG. 16B is a waveform chart depicting the operation of the circuit shown in FIG. 16A. In FIG. 16B, a waveform 1105 indicates the voltage detected by the detection resistor 1010, and the waveform 1106 indicates the voltage detected by the detection resistor 1012. The solid line of a waveform 1107 indicates the voltage that is applied to the – terminal of the comparator 1030, and the dotted line thereof indicates the voltage that is applied to the + terminal of the comparator 1030. The solid line of a waveform 1108 indicates the voltage that is applied to the – terminal of the comparator 1031, and the dotted line thereof indicates the voltage that is applied to the + terminal of the comparator 1031. When the triac 442 is in the OFF state and power is OFF, the voltage is not generated at the detection resistor 1012, and, as a result, the transistor of the secondary side AC coupler 1016 is not activated. Therefore, the voltage at the – terminal of the comparator 1030 becomes a constant voltage that is determined by the voltage division by the resistors 1021, 1022 and 1024, as indicated by the solid line of the waveform 1107. Here, the resistors 1021, 1022 and 1024, and the resistors 1026 and 1027 have been adjusted so that the voltage at the – terminal of the comparator 1030 is greater than the voltage at the + terminal of the comparator 1030. Hence, the output of the comparator 1030 becomes LOW, and the transistor 1034 is activated, and the + terminal of the comparator 1031 becomes HIGH voltage. The voltage at the – terminal of the comparator 1031 becomes a constant voltage that is determined by the voltage division by the resistors 1017, 1018, and 1020, as indicated by the solid line of the waveform 1108, since voltage is not generated at the detection resistor 1010. Here, the resistors 1017, 1018, and 1020 have been adjusted so that the voltage at the + terminal of the comparator 1031 is greater than the voltage at the – terminal of the comparator 1031. Since the voltage at the + terminal is greater than the voltage at the – terminal, the output of the comparator 1031 becomes the open collector output, and the latch units 432 and 436 do not perform the latch operation. When the triacs 442 and 441 are turned ON and power is turned ON, voltage is generated at the detection resistor 1012. As a result, voltage at the – terminal of the comparator 1030 gradually decreases, as indicated by the solid line of the waveform 1107. In the same manner, voltage is generated at the detection resistor 1010, and hence, voltage at the – terminal of the comparator 1031 also gradually decreases, as indicated by the solid line of the waveform 1108. When the voltage at the + terminal of the comparator 1030 exceeds the voltage at the – terminal of the comparator 1030, the output of the comparator 1030 becomes the open collector output. As a result, the transistor 1034 is turned OFF and the voltage that is applied to the + terminal of the comparator 1031 changes to the voltage determined by the resistors 1028 and 1029, as indicated by the waveform 1108. Here, the resistors 1028 and 1029 have been adjusted so that the voltage that is applied to the + terminal of the comparator 1031 is greater than the voltage that is applied to the – terminal thereof. Since the voltage at the + terminal is greater than the voltage at the – terminal, the output of the comparator 1031 becomes the open collector output, and the latch units 432 and 436 do not perform the latch operation. When disconnection is generated at point P, the voltage that passes through the detection resistor 1012 decreases, and voltage at the – terminal of the comparator 1030 gradually increases, as indicated by the solid line of the waveform 1107. Current is flowing, however, to the triac 441, and hence, the increase of voltage at the – terminal of the comparator 1030 remains within a certain range. Even at this time, the resistors 1026 and 1027 have been adjusted so that the voltage that is applied to the + terminal of the comparator 1030 is greater than the voltage that is applied to the – terminal thereof, and hence, the output of the comparator 1030 becomes the open collector output. The voltage at the – terminal of the comparator 1031, on the other hand, voltage increases, as indicated by the solid line of the waveform 1108, since disconnection is generated at point P. Since the voltage at the + terminal of the comparator 1031 does not change, the voltage at the – terminal of the comparator 1031 eventually exceeds the voltage at the + terminal after the disconnection at point P, and the output of the comparator 1031 becomes LOW, whereby the latch units 432 and 436 and the CPU 420 are activated.

As described above, according to Example 6, in the circuit of the disconnection detecting portion 1002, the disconnection at point P can be detected even if the disposed position of the detection resistor 1012 and the connection position of Di1002 are different.

Each of the above examples may be combined with each other if possible.

For example, the disconnection detecting portion in Example 5 or Example 6 may be added to the circuit configuration of Example 2 (between the triacs 443 and 445 in FIG. 7) or circuit configuration of Example 4 (between the triacs 442 and 441 in FIG. 12).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a fixing portion configured to fix an image, formed on a recording material, onto the recording material, the fixing portion including a heater that includes a substrate, a plurality of heat generating blocks arranged on the substrate in a longitudinal direction of the substrate, and a plurality of temperature detecting elements disposed on the substrate; and a control circuit configured to control power to be supplied to the plurality of heat generating blocks, the control circuit including a plurality of semiconductor elements configured to perform switching between ON and OFF of the plurality of heat generating blocks, and a power interrupting unit configured to be activated so as to interrupt power being supplied to the plurality of semiconductor elements when the heater overheats, and selectively controlling the power to be supplied to the plurality of heat generating blocks by selectively controlling the plurality of semiconductor elements, wherein, of the plurality of semiconductor elements, a first semiconductor element to supply power to a first heat generating block, of the plurality of heat generating blocks, is connected, in series, to a second semiconductor element to supply power to a second heat generating block, of the plurality of heat generating blocks, and wherein, when the power interrupting unit is not activated, the second heat generating block is controlled by controlling only the second semiconductor element, and, when the power interrupting unit is not activated, the first heat generating block is controlled by controlling the first semiconductor element and the second semiconductor element.

2. The image forming apparatus according to claim 1, wherein a number of temperature detecting elements disposed in a region of the first heat generating block is fewer than a number of temperature detecting elements disposed in a region of the second heat generating block.

3. The image forming apparatus according to claim 1, wherein the first heat generating block is a heat generating block disposed on an outer side of the second heat generating block in the longitudinal direction of the substrate.

4. The image forming apparatus according to claim 1, wherein the first heat generating block and the second heat generating block are disposed symmetrically in the longitudinal direction of the substrate with respect to a conveyance reference position of the recording material.

5. The image forming apparatus according to claim 1, wherein, of the plurality of heat generating blocks, a third heat generating block and a fourth heat generating block, which are disposed symmetrically in the longitudinal direction of the substrate with respect to a conveyance reference position of the recording material, are controlled by controlling a single semiconductor element, of the plurality of semiconductor elements.

6. The image forming apparatus according to claim 5, wherein a number of temperature detecting elements to detect a temperature of the third heat generating block and a number of temperature detecting elements to detect a temperature of the fourth heat generating block are, respectively, fewer than a number of temperature detecting elements to detect a temperature of the second heat generating block.

7. The image forming apparatus according to claim 1, further comprising a disconnection detecting portion configured to detect whether a current path to the second heat generating block is disconnected, and, when the disconnection detecting portion detects the disconnection of the current path, power supply to at least the second heat generating block, of the plurality of heat generating blocks, is interrupted.

8. An image forming apparatus comprising:

a fixing portion configured to fix an image, formed on a recording material, onto the recording material, the fixing portion including a heater that includes a substrate, a plurality of heat generating blocks arranged on the substrate in a longitudinal direction of the substrate, and a plurality of temperature detecting elements disposed on the substrate;

a control circuit configured to control power to be supplied to the plurality of heat generating blocks, the control circuit including a plurality of semiconductor elements configured to perform switching between ON and OFF of the plurality of heat generating blocks, and selectively controlling the power to be supplied to the plurality of heat generating blocks by selectively controlling the plurality of semiconductor elements; and a disconnection detecting portion configured to detect whether a current path to the second heat generating block is disconnected, and, when the disconnection detecting portion detects the disconnection of the current path, power supply to at least the second heat generating block, of the plurality of heat generating blocks, is interrupted, wherein, of the plurality of semiconductor elements, a first semiconductor element to supply power to a first heat generating block is connected, in series, to a second semiconductor element to supply power to a second heat generating block, of the plurality of heat generating blocks, wherein the second heat generating block is controlled by controlling the second semiconductor element, and the first heat generating block is controlled by controlling the first semiconductor element and the second semiconductor element, and wherein the current path is a second current path, and a first current path to the first heat generating block and the second current path are, respectively, branched from a common third current path, and the disconnection detecting portion includes (i) a first current detecting portion configured to detect current that flows to the first current path, and (ii) a second current detecting portion configured to detect current that flows to the second current path.

9. An image forming apparatus comprising:

a fixing portion configured to fix an image, formed on a recording material, onto the recording material, the fixing portion including a heater that includes a substrate, a plurality of heat generating blocks arranged on the substrate in a longitudinal direction of the substrate, and a plurality of temperature detecting elements disposed on the substrate;

a control circuit configured to control power to be supplied to the plurality of heat generating blocks, the control circuit including a plurality of semiconductor elements configured to perform switching between ON and OFF of the plurality of heat generating blocks, and selectively controlling the power to be supplied to the plurality of heat generating blocks by selectively controlling the plurality of semiconductor elements; and a disconnection detecting portion configured to detect whether a current path to the second heat generating block is disconnected, and, when the disconnection detecting portion detects the disconnection of the current path, power supply to at least the second heat generating block, of the plurality of heat generating blocks, is interrupted, wherein, of the plurality of semiconductor elements, a first semiconductor element to supply power to a first heat generating block is connected, in series, to a second semiconductor element to supply power to a second heat generating block, of the plurality of heat generating blocks, wherein the second heat generating block is controlled by controlling the second semiconductor element, and the first heat generating block is controlled by controlling the first semiconductor element and the second semiconductor element, and wherein the current path is a second current path, and a first current path to the first heat generating block and the second current path are, respectively, branched from a common third current path, and the disconnection detecting portion includes (i) a second current detecting portion configured to detect current that flows to the second current path, and (ii) a third current detecting portion configured to detect current that flows to the third current path.

10. The image forming apparatus according to claim 1, wherein the fixing portion further includes a tubular film, the heater being in contact with an inner surface of the film.

11. The image forming apparatus according to claim 10, wherein the plurality of temperature detecting elements are disposed on a surface of the substrate on an opposite side to the surface on which the plurality of heat generating elements are disposed, and the surface of the heater, on which the plurality of temperature detecting elements are disposed, is in contact with the inner surface of the film.

12. An image forming apparatus comprising:

a fixing portion configured to fix an image, formed on a recording material, onto the recording material, the fixing portion including a heater that includes a substrate, a plurality of heat generating blocks arranged on the substrate in a longitudinal direction of the substrate, and a plurality of temperature detecting elements disposed on the substrate; and a control circuit configured to control power to be supplied to the plurality of heat generating blocks, the control circuit including a plurality of semiconductor elements configured to perform switching between ON and OFF of the plurality of heat generating blocks, and a power interrupting unit configured to be activated so as to interrupt power being supplied to the plurality of semiconductor elements when the heater overheats, and selectively controlling the power to be supplied to the plurality of heat generating blocks by selectively controlling the plurality of semiconductor elements, wherein, of the plurality of semiconductor elements, a first semiconductor element to supply power to a first heat generating block is connected, in series, to a second semiconductor element to supply power to a second heat generating block, of the plurality of heat generating blocks, wherein, when the power interrupting unit is not activated, the second heat generating block is controlled by controlling the second semiconductor element, and, when the power interrupting unit is not activated, the first heat generating block is controlled by controlling the first semiconductor element and the second semiconductor element, and wherein the second heat semiconductor element is a triac.

13. An image forming apparatus comprising:

a fixing portion configured to fix an image, formed on a recording material, onto the recording material, the fixing portion including a heater that includes a substrate, a plurality of heat generating blocks arranged on the substrate in a longitudinal direction of the substrate, and a plurality of temperature detecting elements disposed on the substrate; and a control circuit configured to control power to be supplied to the plurality of heat generating blocks, the control circuit including a plurality of semiconductor elements configured to perform switching between ON and OFF of the plurality of heat generating blocks, and a power interrupting unit configured to be activated so as to interrupt power being supplied to the semiconductor elements when the heater overheats, and selectively controlling the power to be supplied to the plurality of heat generating blocks by selectively controlling the plurality of semiconductor elements, wherein, of the plurality of semiconductor elements, a first semiconductor element to supply power to a first heat generating block is connected, in series, to a second semiconductor element to supply power to a second heat generating block, of the plurality of heat generating blocks, wherein, when the power interrupting unit is not activated, the second heat generating block is controlled by controlling the second semiconductor element, and, when the power interrupting unit is not activated, the first heat generating block is controlled by controlling the first semiconductor element and the second semiconductor element, and wherein the current path is a second current path, a first current path to the first heat generating block and the second current path are, respectively, branched from a common third current path, the first semiconductor element is provided on the first current path, the second semiconductor element is provided on the common third current path, the power interrupting unit is provided on the common third current path on the upstream side from the second semiconductor element, and no semiconductor element is provided on the second current path.

* * * * *